US007960691B2

(12) United States Patent
Matsuo

(10) Patent No.: US 7,960,691 B2
(45) Date of Patent: Jun. 14, 2011

(54) SECOND ION MASS SPECTROMETRY METHOD AND IMAGING METHOD

(75) Inventor: Jiro Matsuo, Uji (JP)

(73) Assignee: Kyoto University, Kyoto (JP)

( * ) Notice: Subject to any disclaimer, the term of this patent is extended or adjusted under 35 U.S.C. 154(b) by 272 days.

(21) Appl. No.: 12/308,326

(22) PCT Filed: Jun. 13, 2007

(86) PCT No.: PCT/JP2007/061864

§ 371 (c)(1),
(2), (4) Date: Dec. 12, 2008

(87) PCT Pub. No.: WO2007/145232

PCT Pub. Date: Dec. 21, 2007

(65) Prior Publication Data

US 2010/0155591 A1 Jun. 24, 2010

(30) Foreign Application Priority Data

Jun. 13, 2006 (JP) ..... 2006-163778

(51) Int. Cl.
*H01J 49/26* (2006.01)
*H01J 49/24* (2006.01)

(52) U.S. Cl. ..... 250/282; 250/281; 250/298; 702/19

(58) Field of Classification Search ..... 250/281, 250/282, 287, 288, 309, 423 R, 492.21, 492.3, 250/294, 298; 436/86; 702/19
See application file for complete search history.

(56) References Cited

U.S. PATENT DOCUMENTS

| | | | | |
|---|---|---|---|---|
| 7,238,952 | B2 * | 7/2007 | Ohtsuka | 250/425 |
| 7,884,318 | B2 * | 2/2011 | Milgram et al. | 250/282 |
| 2005/0029444 | A1 * | 2/2005 | Caprioli | 250/282 |
| 2006/0183235 | A1 * | 8/2006 | Hashimoto et al. | 436/86 |
| 2007/0042496 | A1 | 2/2007 | Okamoto et al. | |
| 2007/0138388 | A1 * | 6/2007 | Ward et al. | 250/288 |
| 2008/0128608 | A1 * | 6/2008 | Northen et al. | 250/282 |
| 2008/0315128 | A1 * | 12/2008 | Sato et al. | 250/492.3 |
| 2009/0189072 | A1 * | 7/2009 | Egan et al. | 250/287 |
| 2010/0227308 | A1 * | 9/2010 | Hashimoto et al. | 435/4 |

FOREIGN PATENT DOCUMENTS

| | | |
|---|---|---|
| JP | 7-161331 | 6/1995 |
| JP | 10-132802 | 5/1998 |
| JP | 2002-116184 | 4/2002 |
| JP | 2004-085546 | 3/2004 |
| JP | 2006-023251 | 1/2006 |

OTHER PUBLICATIONS

Naito, Yasuhide, "Mass Microprobe Aimed at Biological Samples", J. Mass Spectrom. Soc. Jpn., vol. 53, No. 3, 2005, pp. 125-132.

Shimma, et al., "Review of Imaging Mass Spectrometry", J. Mass Spectrom. Soc. Jpn., vol. 53, No. 4, 2005, pp. 230-238.

* cited by examiner

*Primary Examiner* — Bernard E Souw
(74) *Attorney, Agent, or Firm* — Hamre, Schumann, Mueller & Larson, P.C.

(57) ABSTRACT

The provision of a new method for analyzing organic molecules such as protein and endocrine disrupting chemicals with excellent sensitivity. A secondary ion mass spectrometry method using a heavy ion beam as a primary ion beam enables the detection of, for example, an organism-related material at the sub-amol level with high sensitivity. As a result, favorable imaging of an organism-related sample can be performed.

13 Claims, 18 Drawing Sheets

SECOND ION MASS SPECTROMETRY METHOD AND IMAGING METHOD

TECHNICAL FIELD

The present invention relates to a secondary ion mass spectrometry method and an imaging method.

BACKGROUND ART

In recent year, attention has been given to a new technique called imaging mass spectrometry (hereinafter, referred to as "IMS") for analyzing an organism at the molecular level and displaying the analysis as an image in the fields of biochemistry and medicine. IMS is a method in which an arbitrary region of a sample is ionized using, for example, secondary ion mass spectrometry (hereinafter, referred to as "SIMS"), laser desorption/ionization (hereinafter, referred to as "LDI"), or matrix-assisted laser desorption/ionization (hereinafter, referred to as "MALDI"), followed by mass spectrometry using time-of-flight mass spectrometry (TOFMS), whereby a material distribution and a localized state of the sample is visualized (Non-Patent Documents 1 and 2). When this technique is used for the measurement of various organic compounds such as protein, peptide, and endocrine disrupting chemicals, a functional change can be detected at the cellular level, for example, enabling very early diagnosis, tailor-made medicine, the selection of candidates for drug development, investigating the delivery of developed drugs, the elucidation of a vital phenomenon and a disease, and the like. Thus, the technique is expected to be extremely useful.

More specifically, IMS using SIMS is a method in which a sample is irradiated with a primary ion beam accelerated and converged to 3 to 25 keV in high vacuum, so that secondary ions generated when materials are sputtered from a surface of the sample are utilized. In general, a liquid metal ion source (hereinafter, referred to as an "LMI") that generates an ion beam of $G^+$ or $In^+$ is used as a primary ion source, and the diameter of a converged ion beam is generally 1 μm and could be up to 100 nm. A $Cs^+$ ion gun is an inexpensive primary ion source that realizes a spot diameter of 2 to 3 μm.

Further, LDI is a method that uses a laser beam instead of a primary beam as used in SIMS. It is necessary to irradiate a laser with a wavelength to be absorbed by a sample or a medium, an irradiation power density sufficient to vaporize sample molecules, and an appropriate pulse width ($10^6$ to $10^{10}$ W/cm$^2$). A typical light source may be a Nd/YAG laser (wavelength: 266 nm, pulse width: 10 ns, pulse energy: 10 m) emitting fourth harmonics, which is used to realize a spot diameter of approximately 1 to 5 μm, in general.

MALDI is a method in which a laser beam is irradiated onto a surface of a sample to which a matrix that assists in ionizing organic molecules is added. This method has the advantage that the matrix suppresses decomposition of the organic molecules and accelerates desorption or ionization. In general, a light source may be a $N_2$ laser (wavelength: 337 nm, pulse width: 4 ns), a Nd/YAG laser (wavelength: 355 nm, pulse width: 10 ns) emitting third harmonics, or the like with an irradiation power of approximately $10^5$ to $10^8$ W/cm$^2$, which is considerably lower than that of LDI.

Although the use of SIMS achieves an excellent lateral resolution, it leads to the following problems. For example, organic molecules such as protein are destroyed due to an elastic collision between atoms in a biological sample and ions. As a result, measurement can be performed only once per unit, which is a very small division of a sample surface. Further, the production of secondary ions derived from organic molecules gradually is reduced to zero when the total irradiation amount of primary ions exceeds a certain value (static SIMS limit). The static SIMS limit of SIMS is about $10^{12}\times10^{13}$/cm$^2$, and assuming that the primary ion current density is 1 nA/μm$^2$, the irradiation time is about 15 to 150 μs, which becomes a big problem in imaging. As described above, when measurement can be performed only once and the production of secondary ions derived from organic molecules is low with poor ionization efficiency, sufficient measurement cannot be performed. In this manner, a method using SIMS has a problem in sensitivity. Further, SIMS also has a problem of charge-up of a sample due to the electric charge of the primary ions.

Further, since SIMS practically is intended only for a mass range of up to approximately 500, it is not suitable for the measurement of protein and the like. To solve this problem, liquid-SIMS (hereinafter, referred to as "LSIMS") has been proposed, in which a nonvolatile liquid compound such as glycerol is added as a liquid matrix. With this method, the practical mass range can be expanded up to approximately 3000. However, although it is possible to expand the mass range and improve sensitivity by avoiding the problem involving the static SIMS limit, there is a problem in that a material distribution is disturbed.

On the other hand, the use of LDI does not have a problem of charge-up of a sample surface as in SIMS, and causes less decrease in the production of ions that occurs relative to the static SIMS limit of SIMS. However, only a very slight amount of ions can be produced per pulse, and thus it is required to perform measurement and signal integration repeatedly by performing pulse irradiation a plurality of times. Accordingly, this method also has a problem in sensitivity.

As compared with SIMS and LDI practically intended only for a mass range of up to approximately 500, MALDI enables the measurement of a target such as protein whose mass range is beyond the above-described range with very excellent sensitivity. However, there is a problem in that a material distribution may vary depending on the matrix composition and a method of adding the same. Further, due to energy propagation in a matrix, a region where ions are produced becomes larger than the diameter of an irradiation spot. As a result, it is difficult to achieve a high lateral resolution even by converging a laser beam to the maximum extent possible.

Non-Patent Document 1: Yasuhide NAITO, "Mass Microprobe Aimed at Biological Samples", J. Mass. Spectrom. Soc. Jpn. Vol. 53, No. 3, pp. 125-132, 2005

Non-Patent Document 2: Shuichi SHIMMA, Mitsutoshi SETOU, "Review of Imaging Mass Spectrometry", J. Mass. Spectrom. Soc. Jpn. Vol. 53, No. 4, pp. 230-238, 2005

DISCLOSURE OF INVENTION

Problem to be Solved by the Invention

Therefore, it is an object of the present invention to provide a new method that enables an analysis of organic molecules such as protein and endocrine disrupting chemicals with excellent sensitivity.

Means for Solving Problem

The present invention relates to a secondary ion mass spectrometry method with higher sensitivity, including the steps of preparing a sample to be analyzed in which analysis target molecules are present at the amol or sub-amol level in a region to be irradiated with a primary ion beam; irradiating the sample to be analyzed with a primary ion beam; and subjecting secondary ions generated from the sample to be analyzed by the irradiation of the primary ion beam to mass spectrometry. The primary ion beam is a heavy ion beam of 1.25 keV/amu or more.

The present invention further relates to an imaging method using secondary ion mass spectrometry, including the steps of irradiating a sample to be analyzed with a primary ion beam; subjecting secondary ions generated from the sample to be analyzed by the irradiation of the primary ion beam to mass spectrometry; and performing image processing based on a result of the mass spectrometry of the secondary ions obtained. The primary ion beam is a heavy ion beam of 1.25 keV/amu or more.

The present invention further relates to an imaging device including: a secondary ion mass spectrometry means for subjecting a sample to be analyzed to secondary ion mass spectrometry; and an image processing means for performing image processing based on a result of the secondary ion mass spectrometry obtained. The secondary ion mass spectrometry means includes an ion source, an irradiation means for irradiating a surface of the sample to be analyzed with a primary ion beam, and a mass spectrometry means for subjecting secondary ions generated from the sample to be analyzed by the irradiation of the primary ion beam to mass spectrometry. The ion source generates a heavy ion beam of 1.25 keV/amu or more, and the irradiation means includes a control means for controlling the primary ion beam to be generated from the ion source so that it is 1.25 keV/amu or more.

Effects of the Invention

According to the present invention, a heavy ion beam (hereinafter, also referred to as a "fast heavy ion beam") of 1.25 keV/amu or more is used as a primary ion beam in secondary ion mass spectrometry (hereinafter, also referred to as SIMS). As a result, even when a sample to be analyzed is an organism-related material such as protein and polysaccharide, it is possible to suppress the destruction of the organism-related material caused in conventional SIMS, and excellent ionization efficiency is achieved. Therefore, the present invention enables an analysis of an organism-related material such as protein with high sensitivity. Further, since a matrix as used in conventional LSIMS and MALDI is not required, a high lateral resolution can be achieved. Further, since the present invention enables mass spectrometry of an organism-related material with high sensitivity, image display (imaging) can be performed in accordance with the analysis obtained. When image display is possible, the presence of an organism-related material and a distribution thereof can be confirmed easily. Consequently, the present invention is very useful as a new method for analyzing an organism-related material in various fields such as medicine and biology for clinical purpose, in drug development, and the like, for example.

BRIEF DESCRIPTION OF DRAWINGS

FIG. 10A showing a resultant image of 15×15 pixels, FIG. 10B showing a resultant image of 30×30 pixels, and FIG. 10C showing a CCD image for reference.

DESCRIPTION OF THE INVENTION

SIMS

Figure 1:
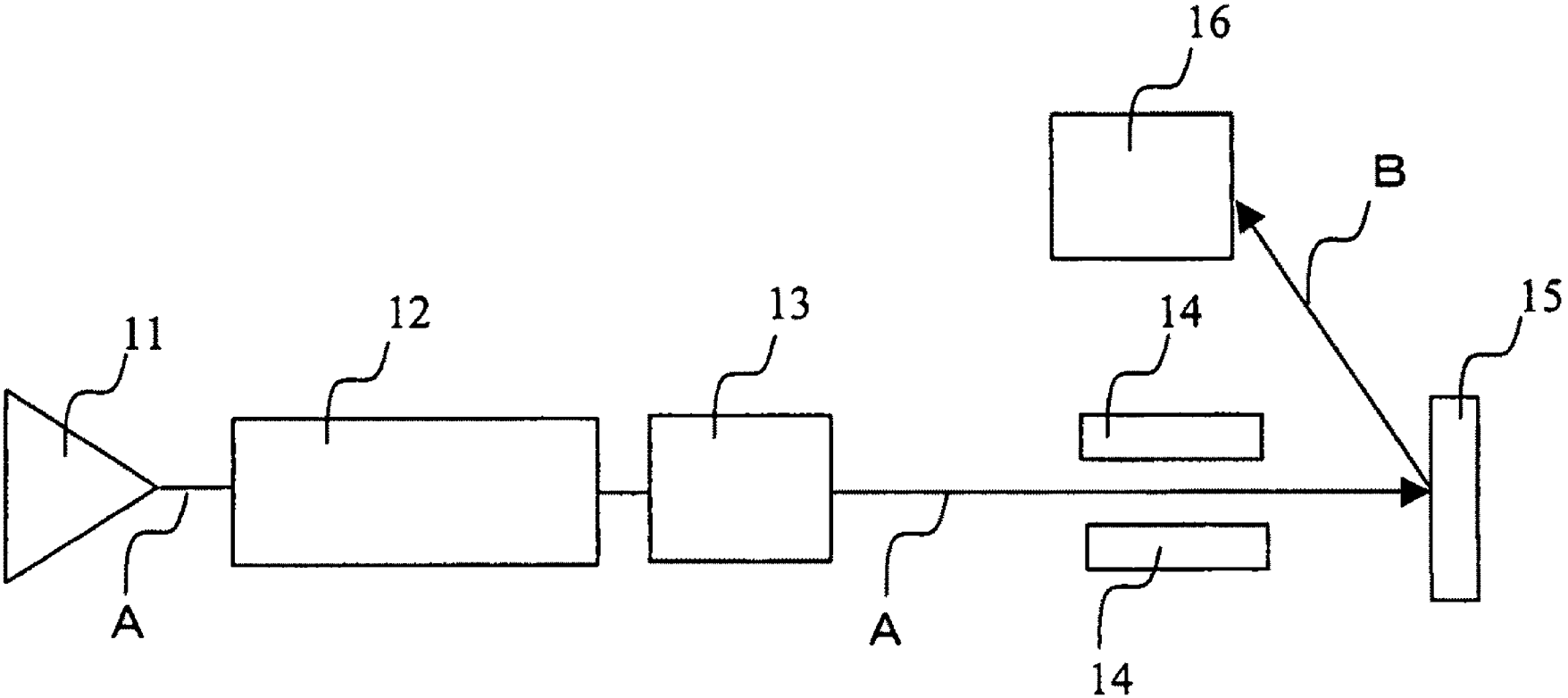
FIG. 1 is a schematic diagram showing an example of a SIMS device of the present invention.

In one aspect, the present invention provides a secondary ion mass spectrometry method (SIMS) with higher sensitivity, including the steps of preparing a sample to be analyzed in which analysis target molecules are present at the amol or sub-amol level in a region to be irradiated with a primary ion beam; irradiating the sample to be analyzed with a primary ion beam; and subjecting secondary ions generated from the sample to be analyzed by the irradiation of the primary ion beam to mass spectrometry. The primary ion beam is a heavy ion beam of 1.25 keV/amu or more. In the present invention, a "heavy ion" refers to an ion heavier than a He ion, and keV/amu is a unit commonly used for expressing the speed of an ion beam, with "amu" being an abbreviation of Atomic Mass Unit.

The speed of the primary ion beam is not limited particularly as long as it is 1.25 keV/amu or more as described above. However, it is preferably 2 keV/amu or more, and more preferably 4 keV/amu or more. Further, the upper limit of the speed is not limited particularly, and it is 83,000 keV/amu or less, for example, preferably 8,300 keV/amu or less, and more preferably 1,250 keV/amu or less.

An ion source of the primary ion beam is not limited particularly, and it may be any one of Au, Ar, Ga, In, Bi, $O_2$, Cs, Xe, $SF_5$, $C_{60}$, Ag, Si, C, Cu, and the like, for example. Among them, Ga, In, Au, Bi and the like are preferable since they facilitate the formation of a high-brightness ion source. In the case of an ion source of Au, the primary ion species may be $Au^+$, $Au^{2+}$, $Au^{3+}$, $Au^{4+}$, or $Au^{5+}$, for example. Since a larger ionic valence leads to higher energy, a multiply-charged ion is preferable.

The primary ion beam is not limited particularly as long as it has the above-described speed. However, the primary ion beam is preferably a heavy ion beam with ion energy that allows an electronic stopping power of the analysis target molecules for the primary ion beam to be equal to or dominant over a nuclear stopping power. Further, in the case of an Au ion, for example, ion energy at a boundary point where the electronic stopping power and the nuclear stopping power of the analysis target molecules for the primary ion beam are equal to each other is preferably 0.5 MeV or more, more preferably 1 MeV or more, and particularly preferably 5 MeV or more. The upper limit of the ion energy is not limited particularly, and it may be 1000 MeV or less, for example. The stopping power refers to the degree to which a charged particle loses its energy due to an interaction with a material while it travels the unit length in the material. More specifically, the electronic stopping power refers to a stopping power (derived from inelastic scattering) generated by an interaction between a charged particle and an electron system of a material, and the nuclear stopping power refers to a stopping power (derived from elastic scattering) generated by an elastic collision between a charged particle and a nucleus. The relationship between the electronic stopping power and the nuclear stopping power of the analysis target molecules for various ion species is known to a person skilled in the art based on a common technical knowledge.

The energy of the primary ion beam is not limited particularly. For example, it is preferably 0.5 MeV or more, more preferably 1 MeV or more, and particularly preferably 5 MeV or more. The upper limit of the energy is not limited particularly, and it may be 1000 MeV or less, for example.

In the present invention, the primary ion beam is generally a converged ion beam, and has a beam diameter of, for example, 5 to 10,000 nm, preferably 5 to 1000 nm, and more preferably 5 to 100 nm. The dose amount of the primary ion beam is not limited particularly, and it is $10^{12}$ to $10^{15}$ ions/$cm^2$, for example, preferably $10^{12}$ to $10^{14}$ ions/$cm^2$, and more preferably $10^{12}$ to $10^{13}$ ions/$cm^2$.

In the present invention, the primary ion beam may be irradiated in a continuous pattern (non-pulse irradiation) or in a non-continuous pattern (pulse irradiation). In the case of pulse irradiation, the beam has a frequency of 100 Hz to 100 kHz, for example, preferably 1 kHz to 100 kHz, and more preferably 1 kHz to 50 kHz, and has a pulse width of 5 to 100 ns, for example, preferably 5 to 20 ns, and more preferably 5 ns or less. The beam can be pulsed by an electrostatic field or a static magnetic field, for example.

Figure 3:
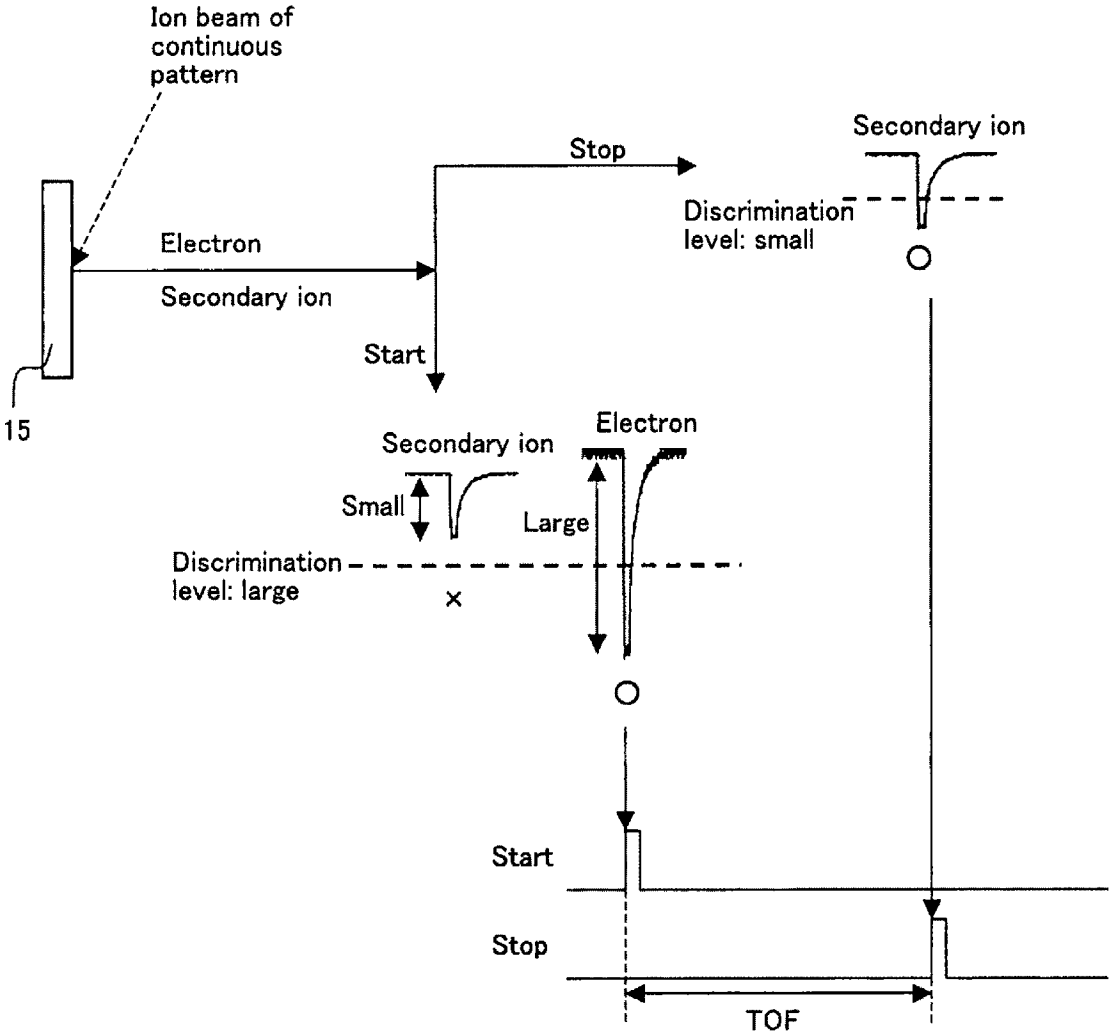
FIG. 3 is a schematic diagram showing an example of SIMS of the present invention.

Time-of-flight ion mass spectrometry (TOFMS) according to the method of the present invention can be performed by pulse irradiation of a primary ion beam as in a conventional method. However, non-pulse irradiation also may be available according to the method of the present invention. The following is a mechanism that enables TOFMS to be performed by non-pulse irradiation. By irradiating a primary ion beam, secondary electrons and secondary ions are generated. The secondary electrons have a pulse higher than that of the secondary ions. Thus, by using the difference in pulse height between the secondary electrons and the secondary ions, the start time and the end time of an analysis are determined. Specifically, as shown in a schematic diagram in FIG. 3, when the sample to be analyzed is irradiated with ions in a continuous pattern, a pulse signal of secondary electrons that is higher than a pulse of secondary ions is extracted first as an analysis start signal. Then, a pulse (lower than that of the secondary electrons) signal of secondary ions generated subsequently is extracted as an analysis end signal. A time between the detection of the analysis start signal and the detection of the analysis end signal is a time of flight (TOF). In this manner, non-pulse irradiation does not use a pulse beam with low ion use efficiency (e.g., 0.1% or less), resulting in an increase in ion use efficiency as well as an improved resolution. Further, non-pulse irradiation requires a smaller amount of beam (about 1 kcps to 100 kcps) than pulse irradiation. The secondary ions to be detected in the present invention may be positive secondary ions or negative secondary ions. However, when an analysis is performed with TOFMS by non-pulse irradiation as described above, it is preferable to detect negative secondary ions. Further, in the case of non-pulse irradiation, a pulse interval may be monitored for the secondary electrons or the like, so that noise due to overlapping pulses can be reduced.

In the present invention, the primary ion beam generally may be irradiated onto the sample to be analyzed in vacuum. The vacuum condition is not limited particularly, and it may be the same as that for conventional SIMS, which is in a range of $10^{-3}$ to $10^{-8}$ Pa, for example. Further, the primary ion beam also can be irradiated in the atmosphere by allowing primary ions to be incident on the sample via a thin film provided for separation from the atmosphere, or maintaining a pressure difference by differential pumping, for example.

According to the secondary ion mass spectrometry method of the present invention, the sample to be analyzed is such that the analysis target molecules may exist at the amol or sub-amol level in a region to be irradiated with the primary ion beam. The sample to be analyzed is not limited particularly as long as it includes the analysis target molecules, and it may be an organism-related sample or the like, for example. In the present invention, the analysis target molecules refer to molecules to be detected in the secondary ion mass spectrometry. The analysis target molecules may be organism-related materials, biopolymers, or the like. Specific examples include protein, polypeptide, amino acid, saccharides such as monosaccharide and polysaccharide, nucleic acids such as DNA and RNA, lipid, endocrine disrupting chemicals, and the like. In the present invention, the organism-related material is not limited to a material isolated from an organism, for example, but may be a material prepared artificially by an enzyme reaction, a chemical synthesis, or the like, for example. In the present invention, the molecular weight of the analysis target molecules is not limited particularly, and it is 50 or more, for example, and preferably 100 or more. The upper limit thereof is not limited particularly, and it is 10,000 or less, 5,000 or less, or 2,000 or less, for example. For example, it is 50 to 10,0000, preferably 100 to 5,000, more preferably 100 to 2,000, and still more preferably 100 to 500.

The secondary ion mass spectrometry method of the present invention is based on the findings that when the energy of a heavy ion beam as the primary ion beam becomes 0.5 MeV or more, for example, the yield of secondary ions is increased, and decomposition of the analysis target molecules does not occur. In general, it has been held that analysis target molecules become more likely to be decomposed when being irradiated with a primary ion beam with higher energy, and accordingly improved sensitivity cannot be expected although the yield may be enhanced. However, according to the secondary ion mass spectrometry method of the present invention, the yield of secondary ions is enhanced, and decomposition of the analysis target molecules is suppressed. Thus, it is possible to detect the analysis target molecules at the amol or sub-amol level, achieving high sensitivity. According to the secondary ion mass spectrometry method of the present invention, it also becomes possible to analyze a slight amount of sample to be analyzed, for example. In the present invention, amol or sub-amol refers to 0.01 to 1,000×$10^{-18}$ moles, for example, and preferably 0.1 to 100×$10^{-18}$ moles. The sample to be analyzed in the secondary ion mass spectrometry method of the present invention is not limited particularly as long as it includes the analysis target molecules at the amol or sub-amol level in at least one region to be irradiated with the primary ion beam.

Further, in order to enhance the yield of secondary ions further, a matrix agent as used in MALDI may be added to the sample to be analyzed, or alternatively a metal thin film may be formed on a surface of the sample to be analyzed by deposition or the like, for example.

The sample to be analyzed generally is arranged on a substrate (stage) for the same. The composition of the substrate is not limited particularly. Examples include a Si substrate, a substrate with a transparent conductive film such as ITO, a metal substrate such as a stainless substrate, as well as an insulating substrate such as a glass substrate on which only a small amount of primary ions are incident, and the like. Further, substrates of Au, Ag, and the like are also preferable because they help enhance the yield of secondary ions further.

<Imaging Method>

In another aspect, the present invention relates to an imaging method using secondary ion mass spectrometry, including the steps of irradiating a sample to be analyzed with a primary ion beam; subjecting secondary ions generated from the sample to be analyzed by the irradiation of the primary ion beam to mass spectrometry; and performing image processing based on a result of the mass spectrometry of the secondary ions obtained. The primary ion beam is a heavy ion beam of 1.25 keV/amu or more. The primary ion beam, its irradiation condition, and the secondary ion mass spectrometry method are as described above. In the imaging method of the present invention, the sample to be analyzed is one including analysis target molecules, such as an organism-related sample, for example. The content of the analysis target molecules is not limited particularly. As described above, the analysis target molecules may be organism-related materials, biopolymers, or the like. The image processing includes, for example, converting the result of the analysis of the secondary ions obtained into an image signal, and displaying the thus-obtained image signal, which can be performed using a conventional well-known method.

The imaging method according to one aspect of the present invention includes: scanning and irradiating an XY plane of the sample to be analyzed with a primary ion beam; subjecting secondary ions generated from each irradiated region of the sample to be analyzed to mass spectrometry; and obtaining an image signal for the each irradiated region of the sample to be analyzed based on a result of the mass spectrometry of the secondary ions, and displaying the image signal corresponding to the each irradiated region on a series of XY coordinates corresponding to the XY plane of the sample to be analyzed.

The method of scanning of the primary ion beam is not limited particularly. For example, the scanning may be performed by moving the sample to be analyzed or deflecting the primary ion beam so that a region to be irradiated is moved. For ease of operation, it is preferable to move the sample to be analyzed using an XY-axis stage or the like, for example.

In the imaging method of the present invention, the size of a pixel is not limited particularly, and it is 0.01×0.01 μm to 10×10 μm, for example, preferably 0.01×0.01 μm to 5×5 μm, and more preferably 0.01×0.01 μm to 1×1 μm. In general, the pixel is a minimum unit obtained by dividing a region to be subjected to image processing, and the length of one side thereof corresponds to a movement amount of a scanning primary ion beam. In other words, in the present invention, the pixel is equivalent to the each irradiated region. Thus, for example, a mass spectrum (analysis result) for each pixel is substituted with an image signal, and the image signal corresponding to the each pixel obtained by dividing a series of XY coordinates is displayed, whereby the sample to be analyzed can be visualized as described below.

The time required for the analysis for one pixel is not limited particularly, and it is 0.01 to 10 sec, for example, preferably 0.01 to 1 sec, and more preferably 0.01 to 0.1 sec.

The imaging method according to another aspect of the present invention includes: irradiating the sample to be analyzed with a primary ion beam, so that secondary ions are generated in a planar form; performing mass spectrometry in a state where a relative positional relationship among the secondary ions in a plane of the sample to be analyzed is maintained; and obtaining an image signal based on a result of the analysis of the secondary ions, and projecting the image signal onto a display portion as an ionic image so that it corresponds to the positional relationship. This method uses an extended ion optical system instead of a scanning primary ion beam as described below. With this method, secondary ions generated from a plurality of positions can be detected simultaneously, for example, which leads to a further reduction in time required for image processing.

<SIMS Device>

Next, a device for performing secondary ion mass spectrometry according to the present invention may be a SIMS device including an ion source, an irradiation means for irradiating a surface of the sample to be analyzed with a primary ion beam, and a mass spectrometry means for subjecting secondary ions generated from the sample to be analyzed by the irradiation of the primary ion beam to mass spectrometry. The ion source generates a heavy ion beam of 1.25 keV/amu or more, and the irradiation means includes a control means for controlling the primary ion beam to be generated from the ion source so that it is 1.25 keV/amu or more. This device is capable of performing the above-described SIMS according to the present invention. The control means is not limited particularly, and it may be a general ion accelerator.

An example of the SIMS device of the present invention is shown in FIG. 1. FIG. 1 shows an example of the SIMS device of the present invention, and the present invention is not limited thereto. The SIMS device shown in the figure is provided with an ion source 11, a primary ion beam irradiation means including an accelerator 12, a switching magnet 13, and a converging/deflecting system 14, and a secondary ion analyzer 16 as a mass spectrometry means. In general, the irradiation means further includes a pair of electrodes (a cathode electrode and an anode electrode) for generating plasma, and an electrode for extracting primary ions, although not shown in the figure. In general, the mass spectrometry means further includes an electrode for extracting secondary ions generated, and an electron multiplier such as a microchannel plate (MCP) for amplifying extracted secondary ions, between a sample 15 to be analyzed and the analyzer 16. Further, the sample 15 to be analyzed generally is arranged on a stage, which is preferably an XY-axis stage that moves on an XY plane for performing a scan analysis.

With this device, SIMS of the sample to be analyzed can be performed in the following manner, for example. Initially, a voltage is applied between the anode electrode and the cathode electrode so as to generate plasma, thereby producing primary ions (heavy ions). Further, a voltage is applied between the anode electrode and the extraction electrode so as to take out the primary ions. Then, the taken-out primary ion beam (shown by A in the figure) is accelerated to 1.25 keV/amu or more by the accelerator 12. The accelerated primary ion beam passes through the switching magnet 13 to be distributed, and is deflected toward the sample to be analyzed by the converging/deflecting system 14 (e.g., a deflection plate). The thus-obtained primary ion beam is irradiated onto the sample 15 (e.g., an organism-related sample) to be analyzed, so that secondary ions (shown by B in the figure) are generated. Then, a voltage is applied to the secondary ion extraction electrode, so that the secondary ions are introduced to the analyzer 16 to be subjected to mass spectrometry (mass/charge ratio). The extracted secondary ions may be allowed to pass through the electron multiplier such as a multi-ion plate (MCP) to be amplified, followed by mass spectrometry by the analyzer 16. Although not shown in the figure, the secondary ions generated by the irradiation of the primary ion beam obtain kinetic energy by an acceleration voltage, and fly within a flight tube toward the analyzer. By making the flight tube longer, or using a reflection analyzer, the resolution can be improved further.

In the above-described device, when the primary ion beam is scanned and irradiated, it is possible to obtain an analysis result on an XY plane of the sample to be analyzed. The scanning may be performed by, for example, moving the stage on which the sample to be analyzed is arranged in X-axis and Y-axis directions, or deflecting the primary ion beam by an electrostatic field or a static magnetic field so that a region to be irradiated is moved.

Further, the device may be used in conjunction with a device (slicer) for slicing a cell such as a microtome, or a two-dimensional electrophoresis device. In the case of using the slicer, a cell can be sliced and analyzed successively, for example, which makes it possible to analyze a three-dimensional distribution, for example. In conventional MALDI in which a sample to be analyzed is prepared by adding a matrix thereto, when the sample is subjected to electrophoresis, it has to be isolated from a gel. According to the present invention, however, it is possible to analyze a sample subjected to electrophoresis as it is. Thus, when the device is used in conjunction with an electrophoresis device, a rapid analysis can be performed with high sensitivity.

<Imaging Device>

In still another aspect, the present invention relates to an imaging device including: a secondary ion mass spectrometry means for subjecting a sample to be analyzed to secondary ion mass spectrometry; and an image processing means for performing image processing based on a result of the secondary ion mass spectrometry obtained. The secondary ion mass spectrometry means includes an ion source, an irradiation means for irradiating a surface of the sample to be analyzed with a primary ion beam, and a mass spectrometry means for subjecting secondary ions generated from the sample to be analyzed by the irradiation of the primary ion beam to mass spectrometry. The ion source generates a heavy ion beam of 1.25 keV/amu or more, and the irradiation means includes a control means for controlling the primary ion beam to be generated from the ion source so that it is 1.25 keV/amu or more. The secondary ion mass spectrometry means may be the above-described SIMS device, for example.

In the imaging device according to one aspect of the present invention, the secondary ion mass spectrometry means includes a scanning means for scanning and irradiating an XY plane of the sample to be analyzed with a primary ion beam. The image processing means includes an image signal generation means for obtaining an image signal for each irradiated region of the sample to be analyzed based on a result of the secondary ion mass spectrometry, and a display means for displaying the image signal corresponding to the each irradiated region on a series of XY coordinates corresponding to the XY plane of the sample to be analyzed. The scanning means may be a deflecting means or a means for moving the sample to be analyzed, for example.

Figure 2:
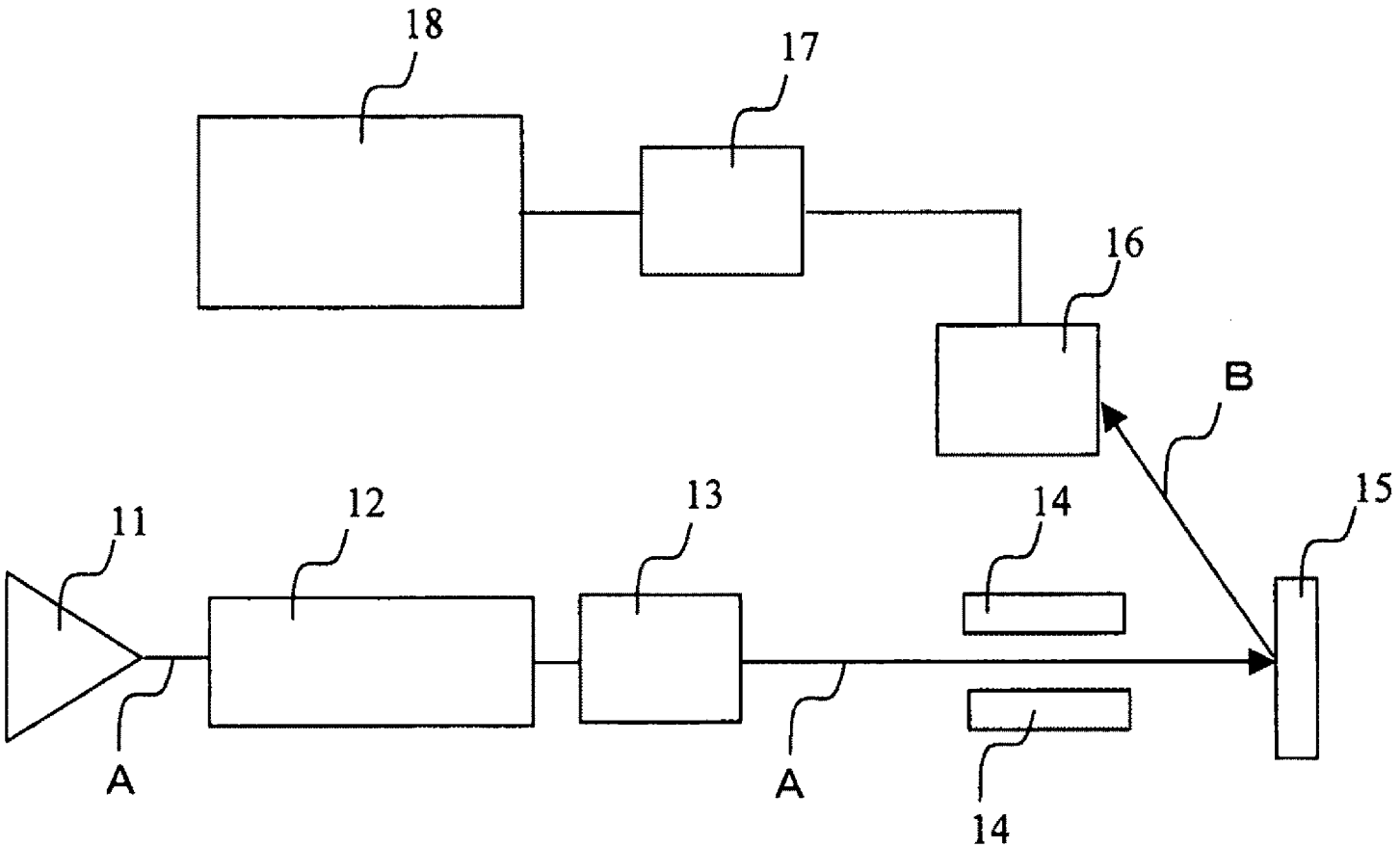
FIG. 2 is a schematic diagram showing an example of an imaging device of the present invention.

An example of the image display device of the present invention is shown in FIG. 2. FIG. 2 shows an example of the image display device of the present invention, and the present invention is not limited thereto. The same parts as those shown in FIG. 1 are denoted with the same reference numerals. The image display device shown in the figure includes, in addition to the components of the SIMS device shown in FIG. 1, a calculation portion 17 as the image signal generation means and a display portion 18. With this device, imaging of the sample to be analyzed can be performed in the following manner, for example.

Initially, in the same manner as described above, an XY plane of the sample 15 to be analyzed is scanned and irradiated with a primary ion beam (shown by A in the figure), and secondary ions (shown by B in the figure) generated are subjected to mass spectrometry by the analyzer 16. A result of the mass spectrometry is input to the calculation portion 17 so as to be converted into an image signal. The image signal thus obtained is input to the display portion 18, so that a two-dimensional image of the sample 15 to be analyzed is displayed. Specifically, an analysis result for each pixel is obtained by the scanning irradiation, and each analysis result is converted into an image signal. The image signal corresponding to the each pixel is displayed on a series of XY coordinates corresponding to the XY plane of the sample to be analyzed. In this manner, a two-dimensional image of the sample to be analyzed can be displayed.

The conversion from the analysis result into the image signal by the calculation portion 17 is not limited particularly, and a conventional well-known method can be used. Specifically, for example, the strength of an ion signal (e.g., the number of ion counts, an ion current value, or the like) for each pixel may be substituted with a signal indicating color intensity with respect to each m/z as a target. For example, setting can be performed such that an ion signal with relatively higher strength results in a relatively darker color and an ion signal with relatively lower strength results in a relatively lighter color. In this manner, the analysis result (strength of an ion signal) is substituted with a signal indicating a color density, and the signal thus obtained is input to the display portion. At the time of display, a color indicated by the image signal for each pixel is displayed on the coordinates (x, y) of the each pixel (each irradiated region) of the sample to be analyzed with reference to an X-axis and a Y-axis on the XY plane of the sample to be analyzed. As a result, the sample to be analyzed is displayed as a two-dimensional image with color intensity. Color intensity can be expressed by, for example, the gray scale, which is a series of tones between white and black that are divided in phase depending on the color density. In addition, the sample to be analyzed also can be displayed as a three-dimensional figure with a Z-axis (vertical axis) representing the strength of an ion signal, or as a color image, for example. In particular, in the case of displaying the sample to be analyzed as a color image, when a different hue is provided with respect to each m/z as a target, for example, distributions of a plurality of materials can be displayed in one image.

Further, instead of the method in which a primary ion beam is scanned (i.e., a so-called "scanning mode"), an extended ion optical system may be used. This is a method (stigmatic mode: projection type) in which in order to reflect a two-dimensional distribution of an objective material on a surface of the sample to be analyzed, secondary ions are generated in a planar form and are analyzed with their relative positional relationship maintained, thereby projecting an analysis result onto the display portion as an ionic image with the positional relationship. Specifically, for example, an extended ion optical system (e.g., an electrostatic lens, an objective lens in an electrostatic field or a static magnetic field, or the like) may be arranged upstream or downstream of the analyzer (detector), so that a magnified ionic image can be projected onto the display portion. With this method, secondary ions generated from a plurality of positions can be detected simultaneously, which leads to a further reduction in time required for image processing.

Example 1

A fast heavy ion beam of MeV was irradiated, and secondary ions thus generated were detected, whereby trehalose was analyzed.

Figure 4:
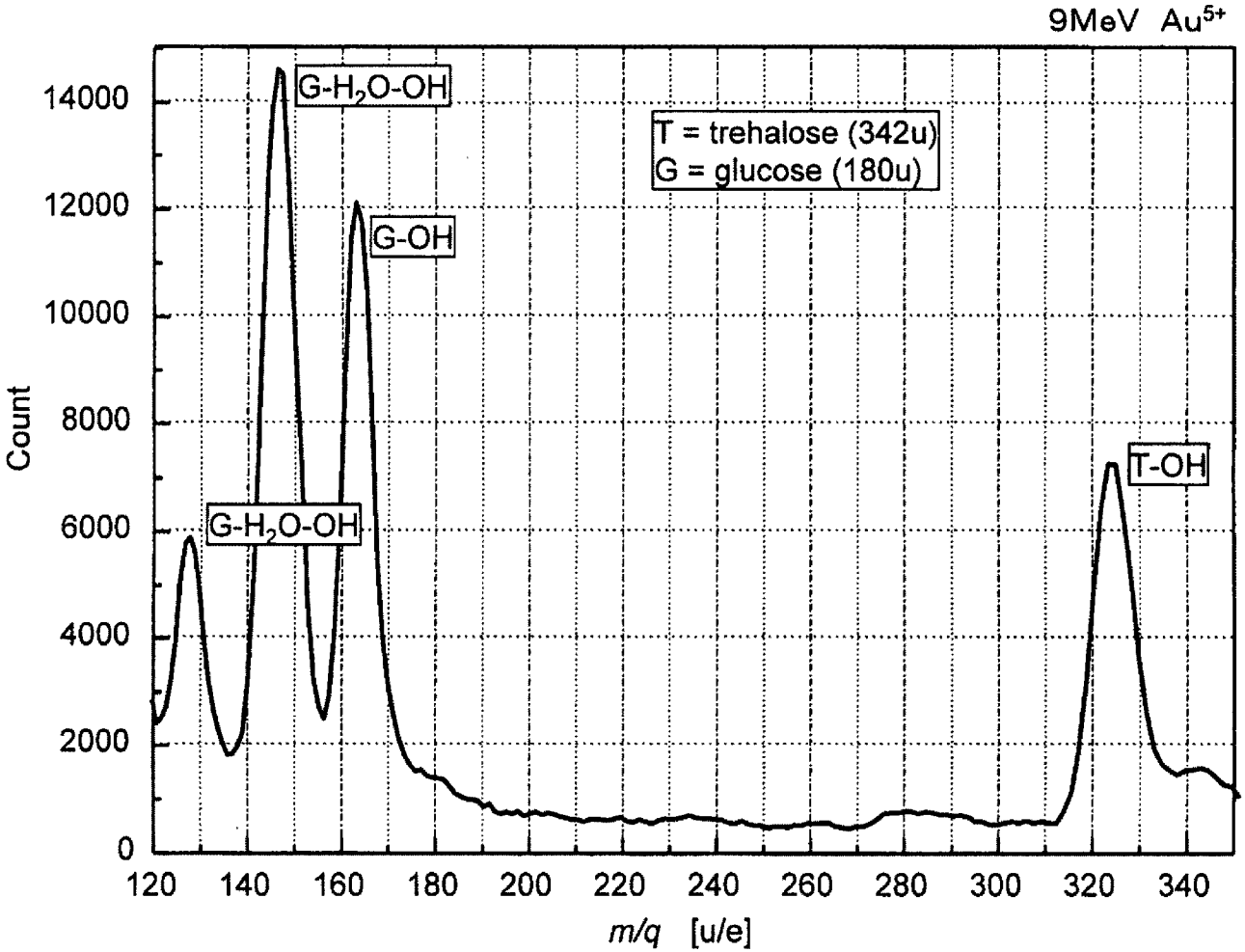
FIG. 4 shows a resultant mass spectrum for a trehalose thin film in an example of the present invention.

A trehalose solution was spincoated on a single crystal Si substrate so as to form a trehalose thin film having a thickness of 100 nm. Then, the trehalose thin film was irradiated with a fast heavy ion beam under the following conditions, and secondary ions (negative ions) thus generated were detected. FIG. 4 shows a resultant mass spectrum obtained when an ion beam of 9 MeV ($Au^{5+}$) was irradiated.

(Condition)

Incident ion: 3 MeV (15 keV/amu)

6 MeV (30 keV/amu)

9 MeV (45 keV/amu)

Sample: trehalose thin film (molecular weight: 342.30)

Beam amount: −10 pA (F.C. measurement with a suppressor)

Beam diameter: 2 mm

Pulse: 50 nanoseconds, repetition: 10 kHz

Measuring time: 500 seconds

Irradiation amount per measurement: $-10^6$ ions ($-10^8$ ions/cm$^2$)

Incident angle: 30°

As shown in FIG. 4, by the irradiation of an ion beam of 9 MeV, a peak of trehalose (T-OH) formed from two glucose molecules bonded together was detected in the spectrum. In the case of usual SIMS, a 1,1 bond between two glucose molecules is cleaved, and thus it is impossible to detect disaccharide trehalose. However, the irradiation of an ion beam of MeV was found to enable detection of trehalose without cleaving the bond.

Figure 5:
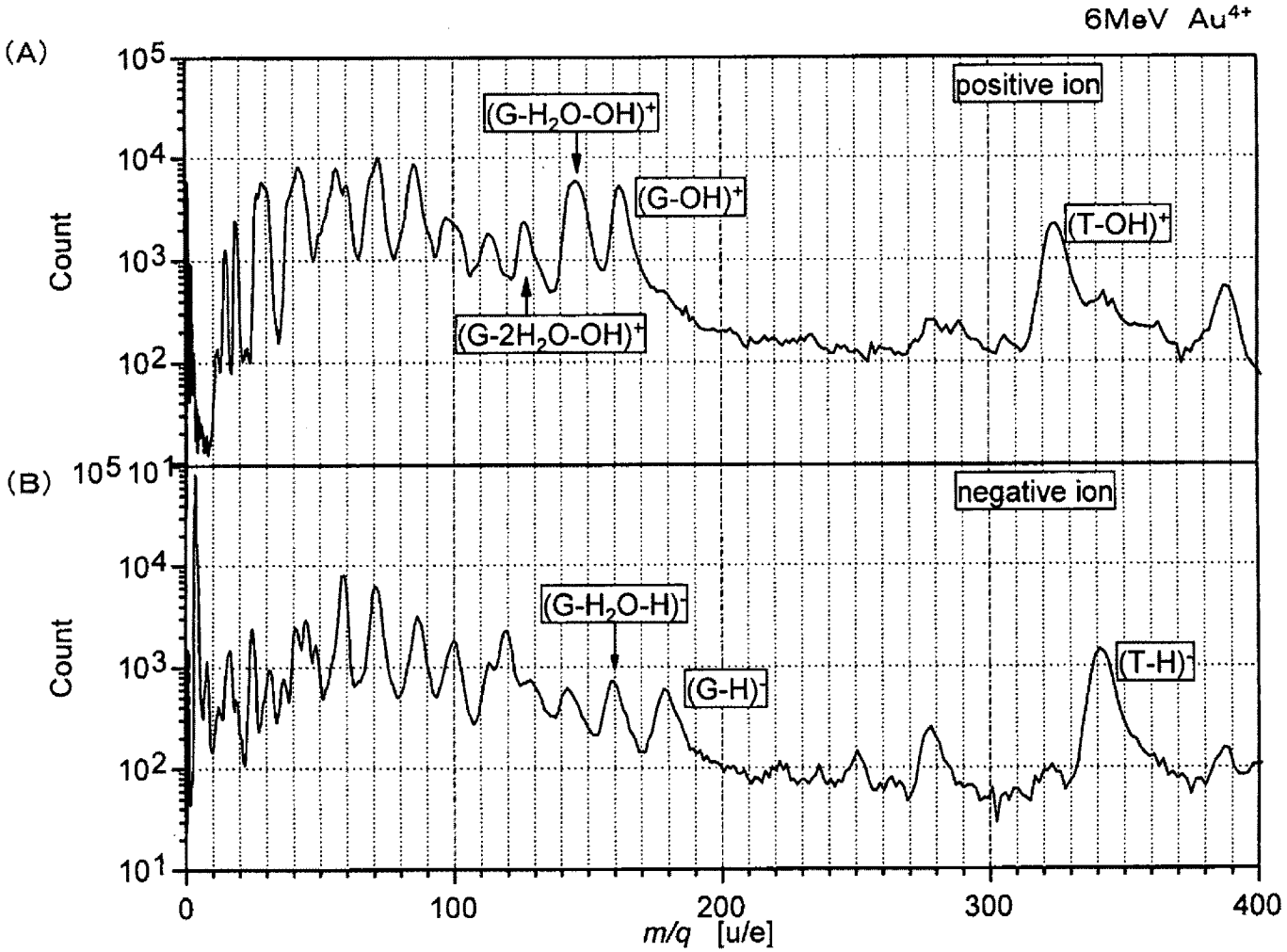
FIG. 5 shows resultant mass spectra for a trehalose thin film in another example of the present invention; A showing a result obtained for positive ions, and B showing a result obtained for negative ions.

Further, the trehalose thin film was irradiated with an ion beam (6 MeV $Au^{4+}$) similarly, and positive ions and negative ions thus generated were detected respectively. The results are shown in FIG. 5. In FIG. 5, A shows a mass spectrum for positive ions, and B shows a mass spectrum for negative ions. As shown in the figure, peaks of trehalose ($T\text{-}OH^+$, $T\text{-}H^-$) were detected by the positive ions and the negative ions, respectively. In particular, in the case of trehalose, it is preferable to detect negative ions since the peak of trehalose is larger than that of glucose.

Figure 6A:
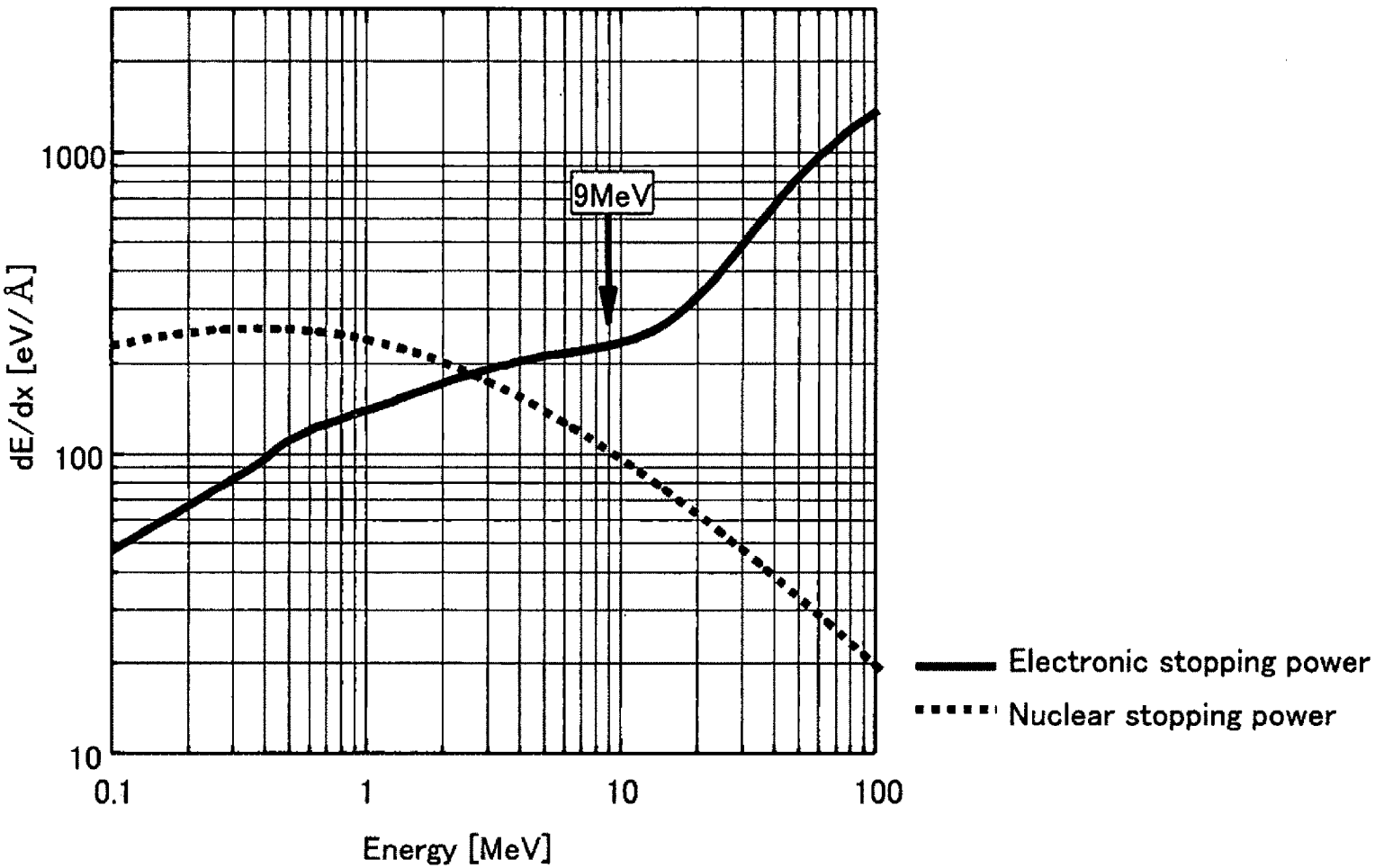
FIG. 6A is a graph showing the relationship between stopping powers (an electronic stopping power and a nuclear stopping power) of trehalose for an Au ion beam and the energy of the ion beam.

FIG. 6A shows the relationship between stopping powers (an electronic stopping power and a nuclear stopping power) of trehalose for an Au ion beam and the energy of the ion beam. In the figure, the vertical axis represents stopping powers (eV/A), the horizontal axis represents energy (MeV), a solid line indicates a resultant electronic stopping power, and a broken line indicates a resultant nuclear stopping power. In view of the fact that the electronic stopping power is dominant when the energy of the ion beam to be irradiated is about 3 MeV or more as shown in the figure, it can be said that ion irradiation of at least 1 MeV or more achieves the same result as described above.

Figure 6B:
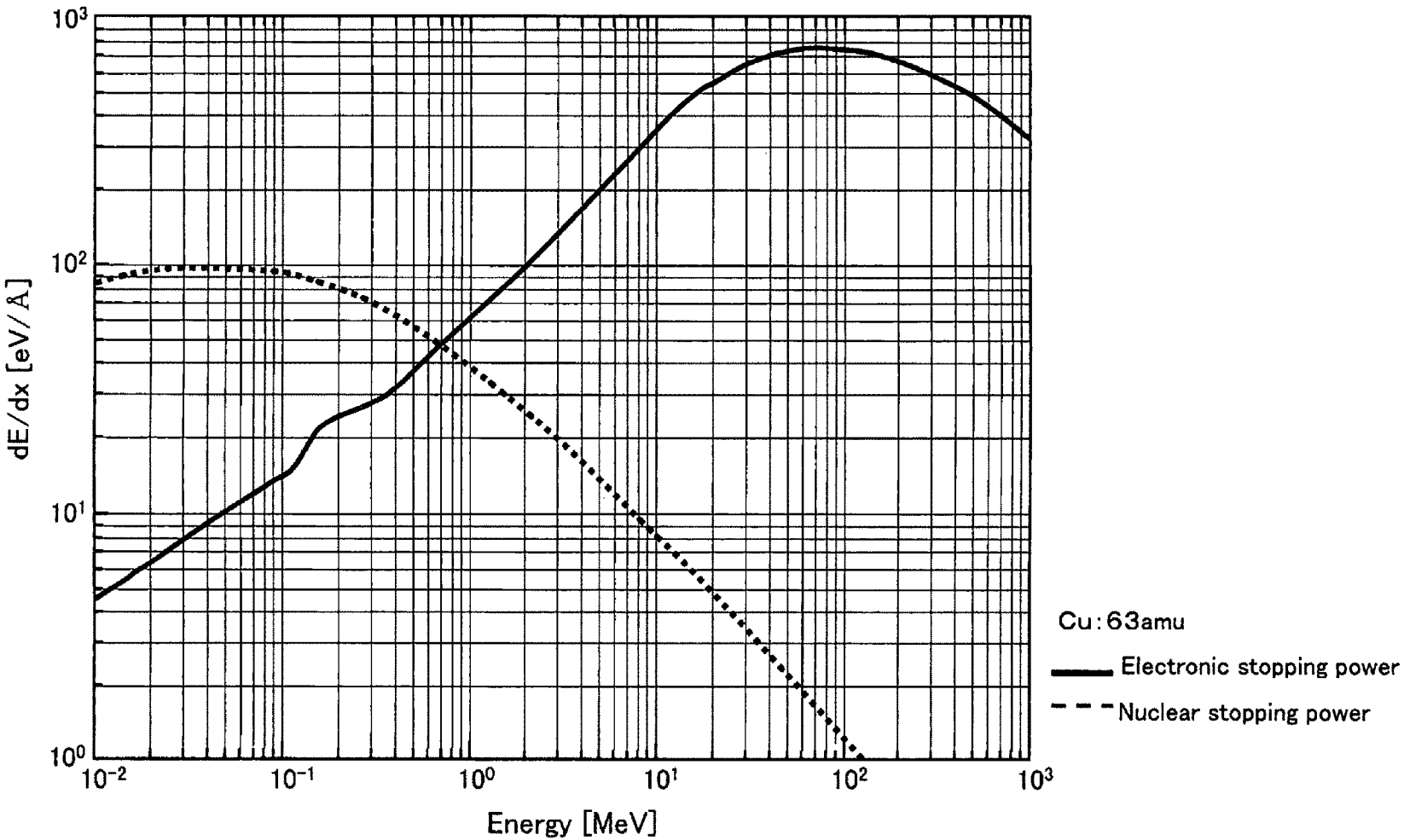
FIG. 6B is a graph showing the relationship between stopping powers (an electronic stopping power and a nuclear stopping power) of trehalose for a copper ion beam and the energy of the ion beam.

FIG. 6B shows the relationship between stopping powers (an electronic stopping power and a nuclear stopping power) of trehalose for a Cu ion beam and the energy of the ion beam. In the figure, the vertical axis represents stopping powers (eV/A), the horizontal axis represents energy (MeV), a left mountain-shaped line indicates an electronic stopping power, and a right mountain-shaped line indicates a nuclear stopping power. As shown in the figure, the electronic stopping power and the nuclear stopping power are equal when the energy is 700 keV, 11 keV/amu, and the electronic stopping power is twice as high as the nuclear stopping power when the energy is 1200 keV, 19 keV/amu.

Figure 6C:
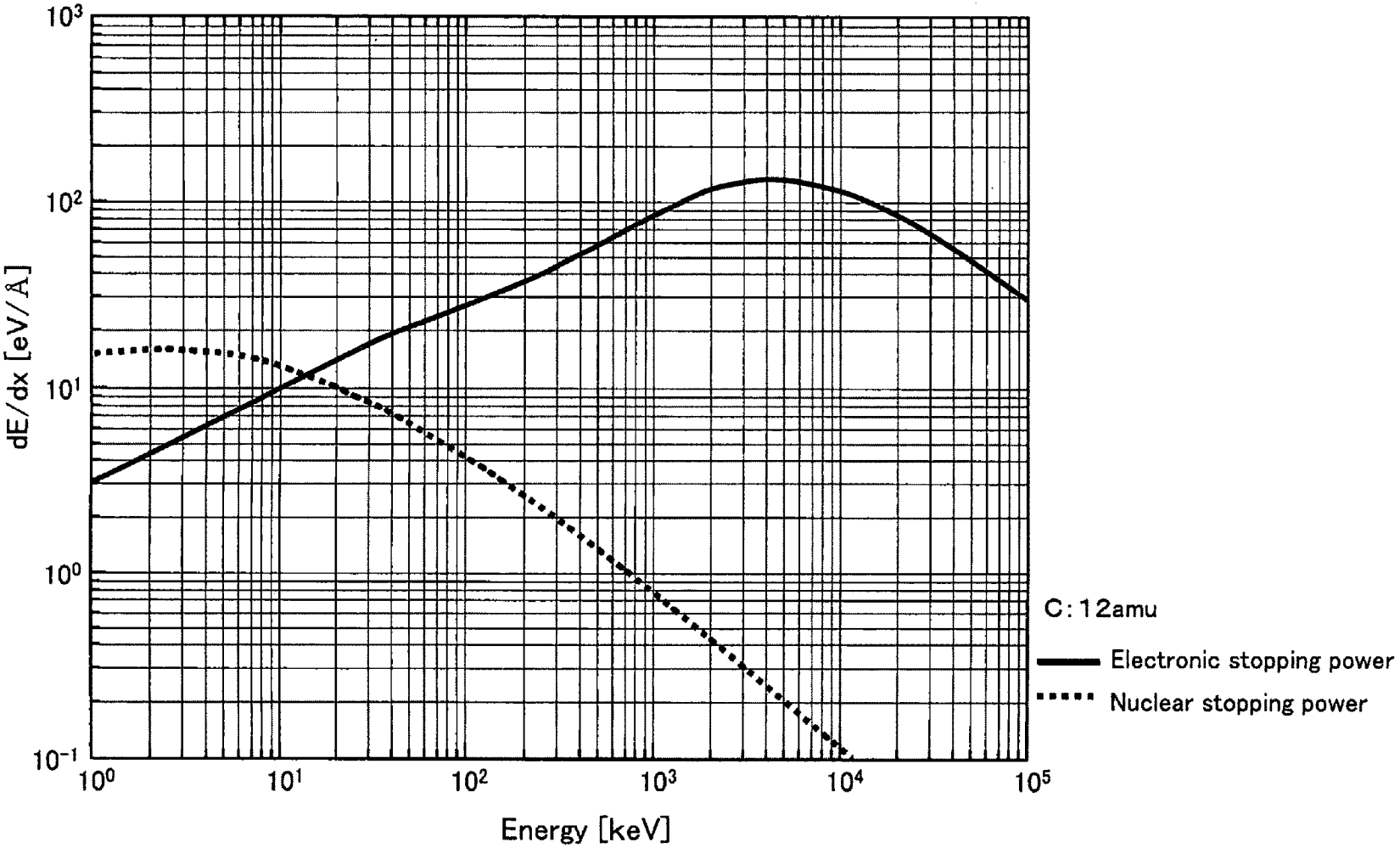
FIG. 6C is a graph showing the relationship between stopping powers (an electronic stopping power and a nuclear stopping power) of trehalose for a carbon ion beam and the energy of the ion beam.

FIG. 6C shows the relationship between stopping powers (an electronic stopping power and a nuclear stopping power) of trehalose for a C ion beam and the energy of the ion beam. In the figure, the vertical axis represents stopping powers (eV/A), the horizontal axis represents energy (MeV), a left mountain-shaped line indicates an electronic stopping power, and a right mountain-shaped line indicates a nuclear stopping power. As shown in the figure, the electronic stopping power and the nuclear stopping power are equal when the energy is 15 keV, 1.25 keV/amu, and the electronic stopping power is twice as high as the nuclear stopping power when the energy is 30 keV, 25 keV/amu.

Example 2

A fast heavy ion beam ($Au^{5+}$) of 9 MeV was irradiated, and secondary ions thus generated were detected, whereby arginine was analyzed.

Figure 7:
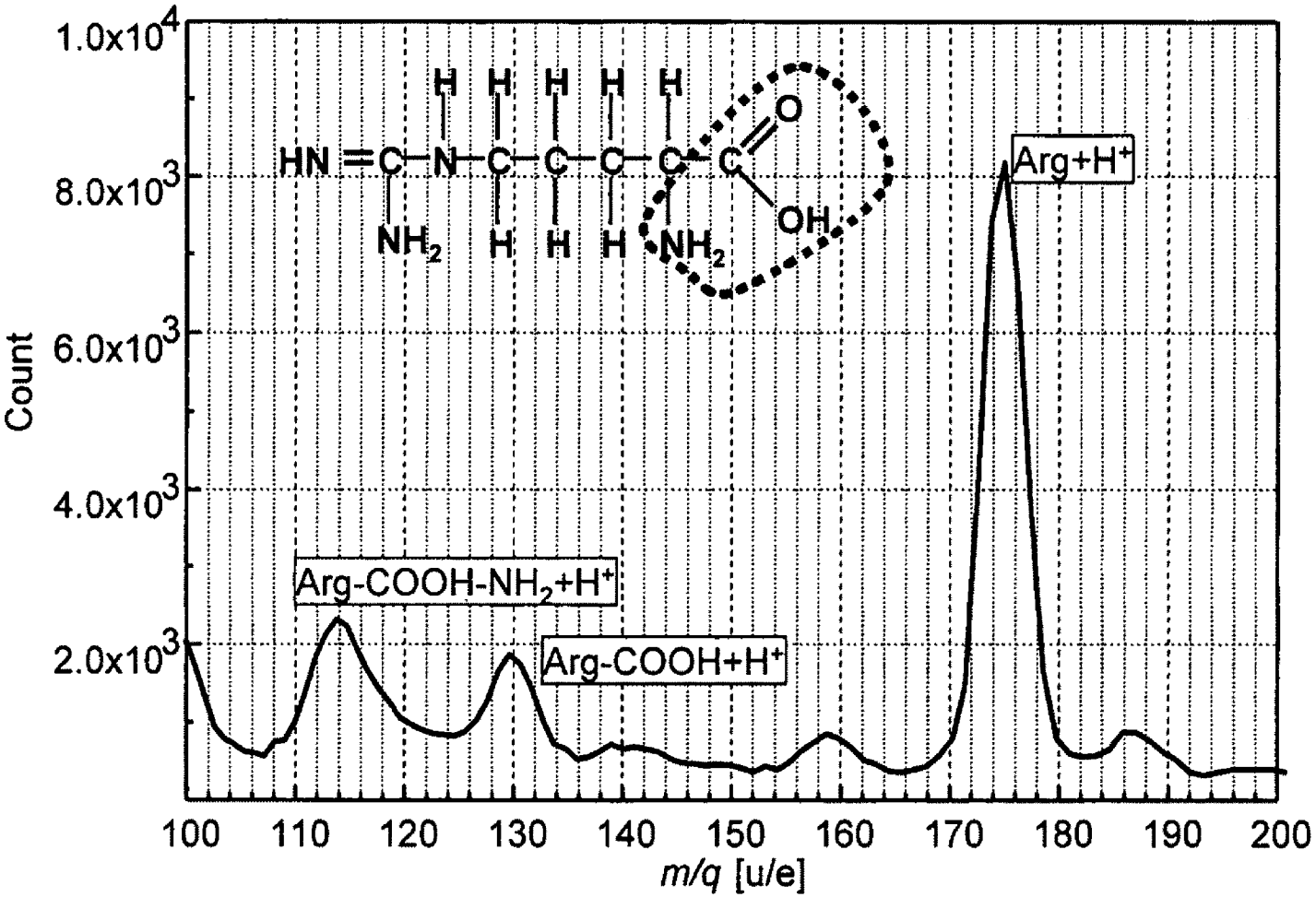
FIG. 7 shows a resultant mass spectrum for an arginine thin film in still another example of the present invention.

An arginine solution was spincoated on a single crystal Si substrate so as to form an arginine thin film (molecular weight: 174.2) having a thickness of 100 nm. Then, the arginine thin film was irradiated with an ion beam of MeV under the same conditions as in Example 1, and secondary ions (positive ions) were detected. FIG. 7 shows a resultant mass spectrum.

As shown in FIG. 7, a peak of arginine was detected. In particular, a large peak of parent ions $(Arg+H)^+$ was observed, which proved that amino acid was less likely to be decomposed even by the irradiation of an ion beam of MeV.

Example 3

(1) A trehalose thin film and an arginine thin film were formed on respective surfaces of Si substrates in the same manners as in Examples 1 and 2, and the relationship between the yield of secondary ions generated and an electronic stopping power was confirmed. The yield of secondary ions was obtained as a ratio between secondary ions and primary ions (secondary ion/primary ion). The ion species, the energy, and the normalized energy (square of the speed) of an ion beam to be irradiated are as follows.

TABLE 1

| Energy | Normalized energy | Ion species |
|---|---|---|
| 10 keV | 0.25 keV/amu | $Ar^{+}$ |
| 0.5 MeV | 2.5 keV/amu | $Au^{+}$ |
| 1 MeV | 5 keV/amu | $Au^{2+}$ |
| 1.5 MeV | 7.5 keV/amu | $Ar^{+}$ |
| 3 MeV | 15 keV/amu | $Ar^{3+}$ |
| 6 MeV | 30 keV/amu | $Au^{4+}$ |
| 9 MeV | 45 keV/amu | $Au^{5+}$ |

Figure 8:
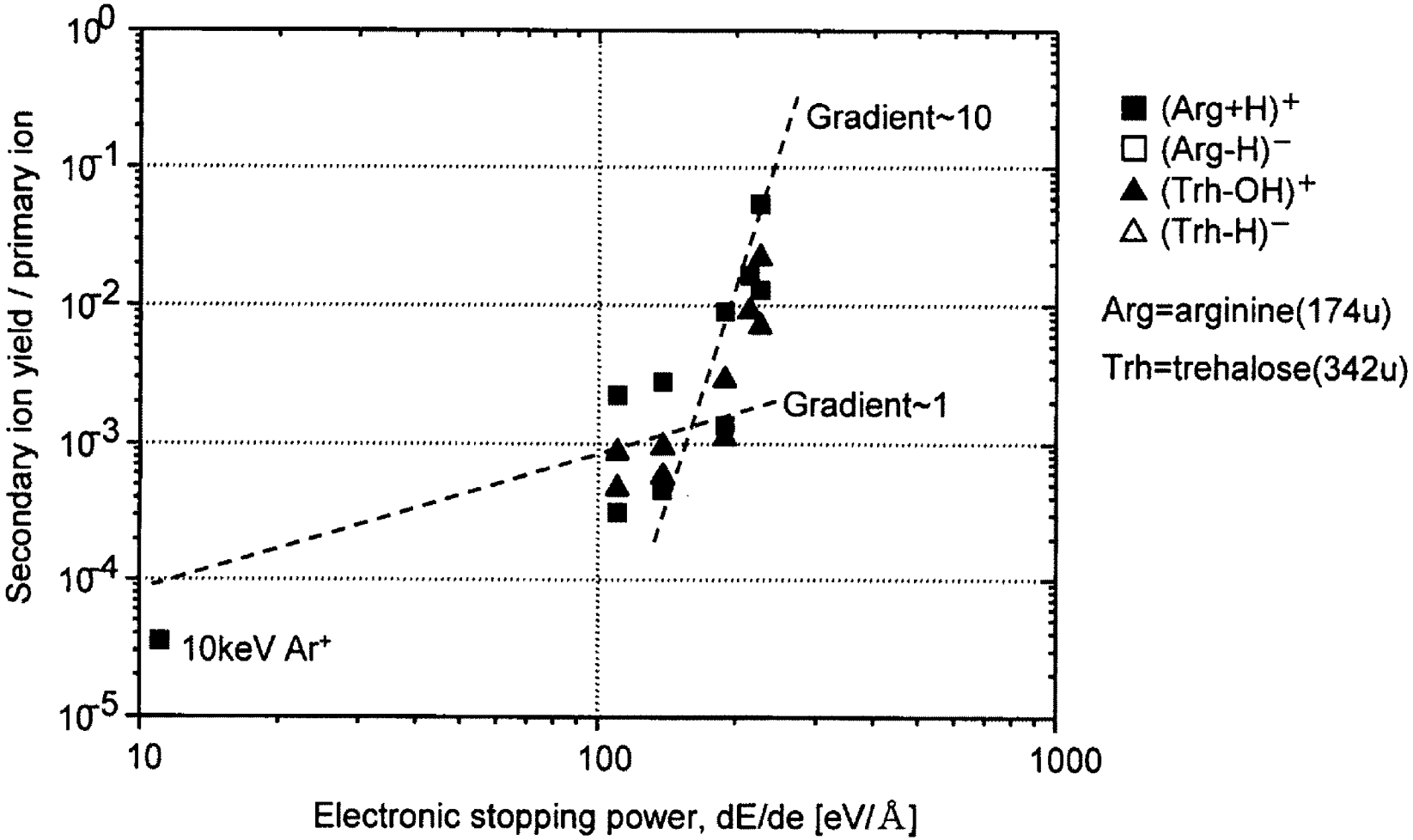
FIG. 8 is a graph showing the relationship between the yield of secondary ions and an electronic stopping power in still another example of the present invention.

The results are shown in FIG. 8. In the figure, a number represents the energy (unit: MeV) of an ion beam, and symbols (■), (□), (▲), and (Δ) represent results of positive ions of arginine, negative ions of arginine, positive ions of trehalose, and negative ions of trehalose, respectively. As shown in the figure, the yield of secondary ions (Yield=Secondary ion/primary ion) is enhanced by irradiating an ion beam with a high electronic stopping power. In other words, the irradiation of an ion beam with high energy increases the ionization efficiency.

(2) An arginine thin film was irradiated with an ion beam with different energy, and the relationship between a yield ratio between parent ions and decomposition ions and an electronic stopping power was confirmed.

Figure 9:
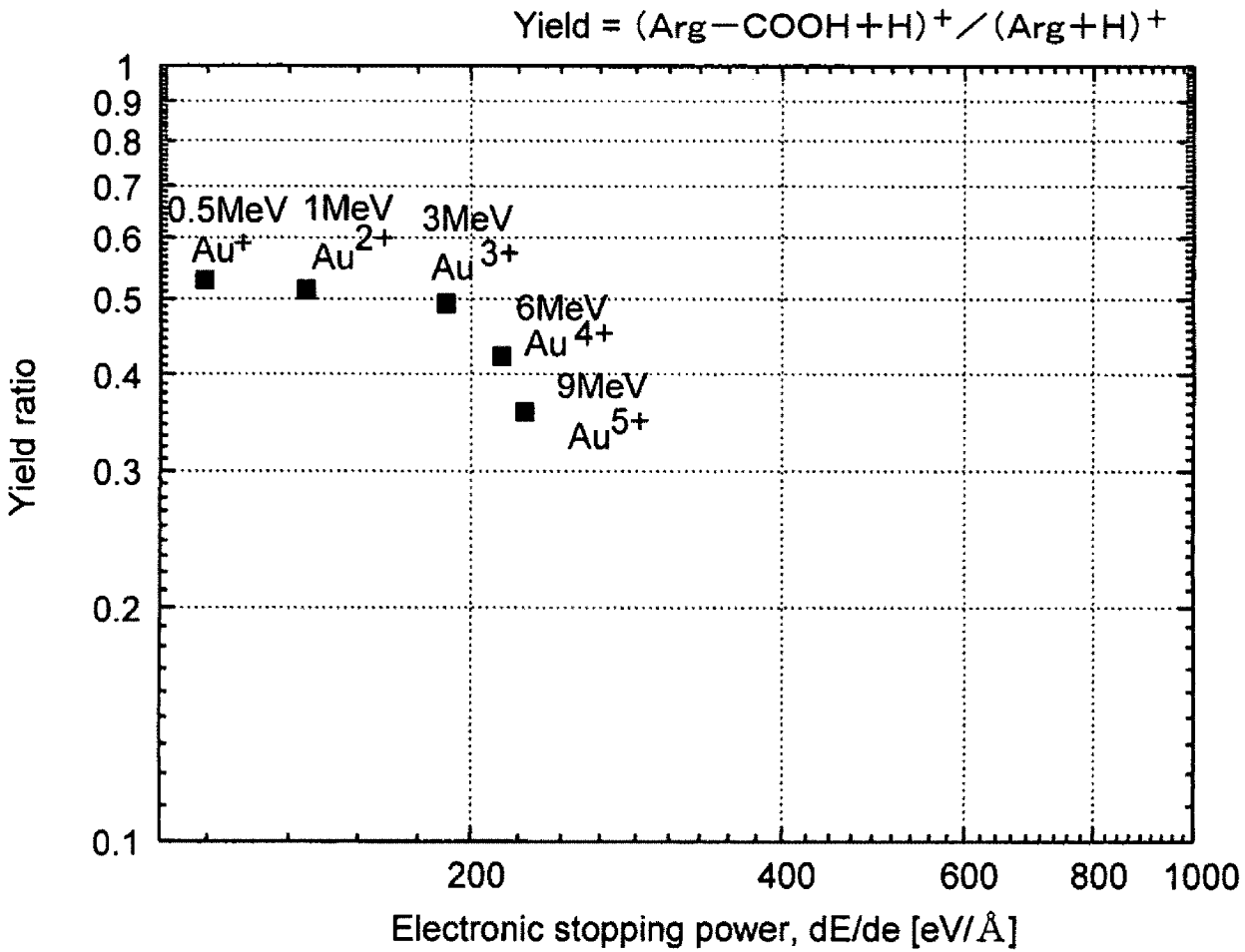
FIG. 9 is a graph showing the ratio between parent ions and decomposition ions in still another example of the present invention.

An arginine thin film was formed on a Si substrate in the same manner as in Example 2. Then, an analysis was performed in the same manner as in the above-described example except that the energy of an ion beam (Au ion) was changed to be 0.5 MeV, 1 MeV, 3 MeV, 6 MeV, and 9 MeV. Then, a ratio between parent ions $(Arg+H)^{+}$ and decomposition ions $(Arg-COOH+H)^{+}$ thus generated was obtained as a yield ratio $(Arg-COOH+H)^{+}/(Arg+H)^{+}$. The result is shown in FIG. 9.

As shown in the figure, decomposition ions were decreased by irradiating an ion beam with a high electronic stopping power. In other words, the irradiation of an ion beam with high energy can suppress the generation of decomposition ions and generate parent ions efficiently.

(3) Detection Level

As described above, when a primary ion beam of 9 MeV $Au^{5+}$ is irradiated onto trehalose, the yield of trehalose molecular ions is about 0.1 molecule ions/primary ions. Thus, assuming that (i) the beam has a diameter of 0.3 μm, (ii) the limit dose is $10^{12}$ primary ions/$cm^2$ or less, and (iii) a monomolecular layer ($2\times10^{14}$ molecules/$cm^2$) of trehalose is adsorbed on a surface of the substrate, 100 trehalose molecular ions can be detected. At this time, the number of trehalose molecules on the surface is $2\times10^{5}$, and accordingly it is estimated that 0.3 amol of molecules can be detected.

Further, consideration is given as to how many trehalose molecular ions can be detected per pixel when imaging is performed. When a primary ion beam of 9 MeV $Au^{5+}$ is irradiated onto trehalose, the yield of trehalose molecular ions is thought to be about 0.1 molecule ions/primary ions in consideration of the detection efficiency of the electron multiplier such as a MCP. Thus, assuming that (i) one pixel is of 1 μm×1 μm $(10^{-8}\ cm)^2$, and (ii) the limit dose is $10^{12}$ primary ions/$cm^2$ or less, 1000 trehalose molecular ions can be detected per pixel. This result shows that sufficient molecules can be detected in imaging.

Example 4

(1) A triglycine (Gly-Gly-Gly) thin film whose surface was covered with a mesh was irradiated with a copper ion beam (95 keV/amu) of 6 MeV, and mass spectrometry was performed, followed by imaging processing based on a result of the analysis. Note here that the same conditions as those in Example 1 were used unless otherwise specified.

A triglycine solution was spin-coated on a Si substrate so as to form a triglycine thin film (1 cm×1 cm) having a thickness of 100 nm. Further, the triglycine thin film was covered with a mesh. The mesh had 70 wires per inch (with a 360-μm spacing between the wires), each having a thickness of about 30 μm.

Figure 10:
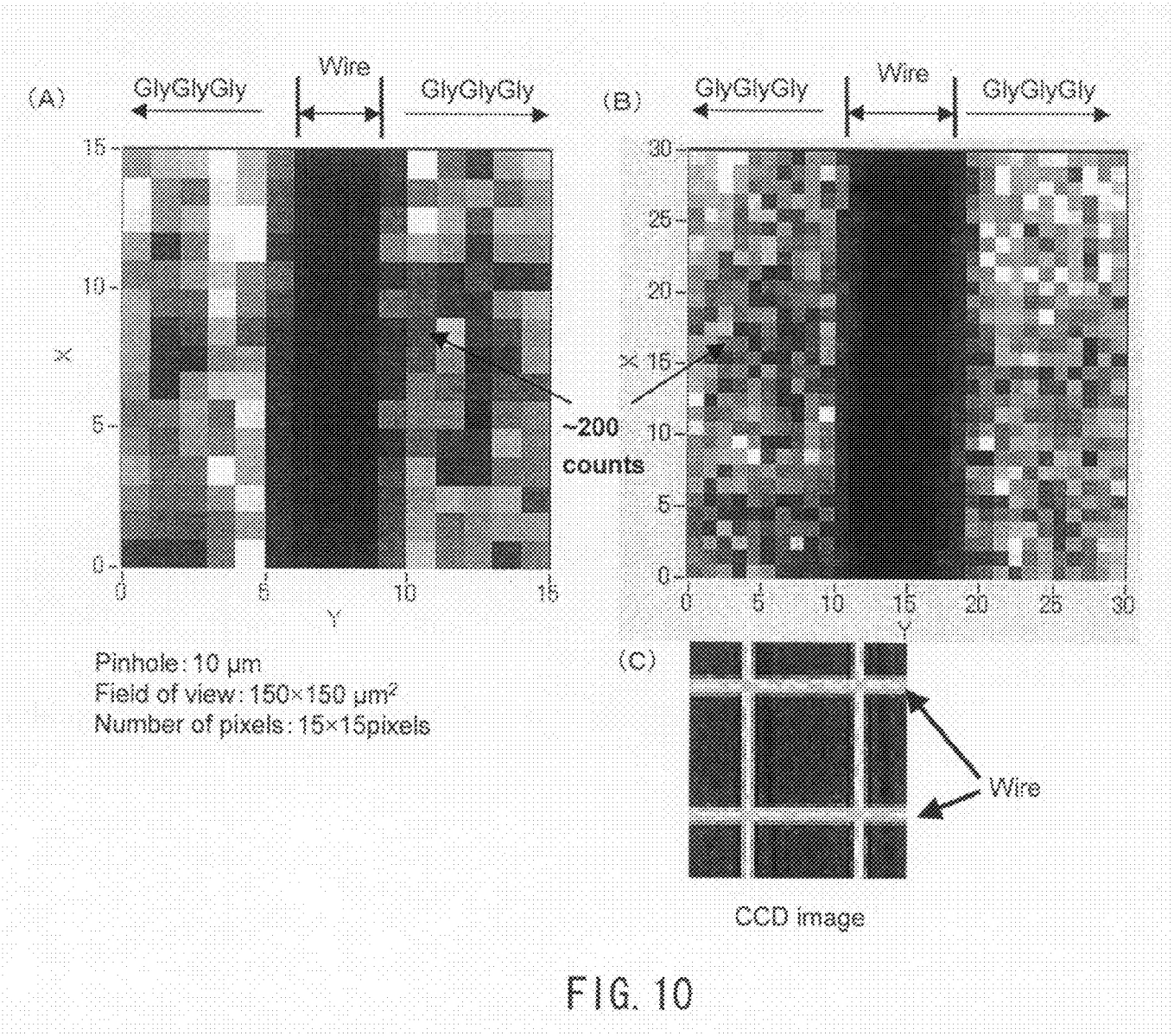
FIGS. 10A to 10C show an image of a triglycine thin film in still another example of the present invention.

Then, a surface of the triglycine thin film was scanned and irradiated with a fast heavy ion beam (copper ion beam) of 6 MeV, and secondary ions (negative ions) were detected, followed by image processing using a result of the detection. An image thus obtained is shown in FIGS. 10A to 10C. FIG. 10A shows a resultant image of 15×15 pixels, and FIG. 10B shows a resultant image of 30×30 pixels. An optical microscope image also is shown in FIG. 10C.

Figure 11:
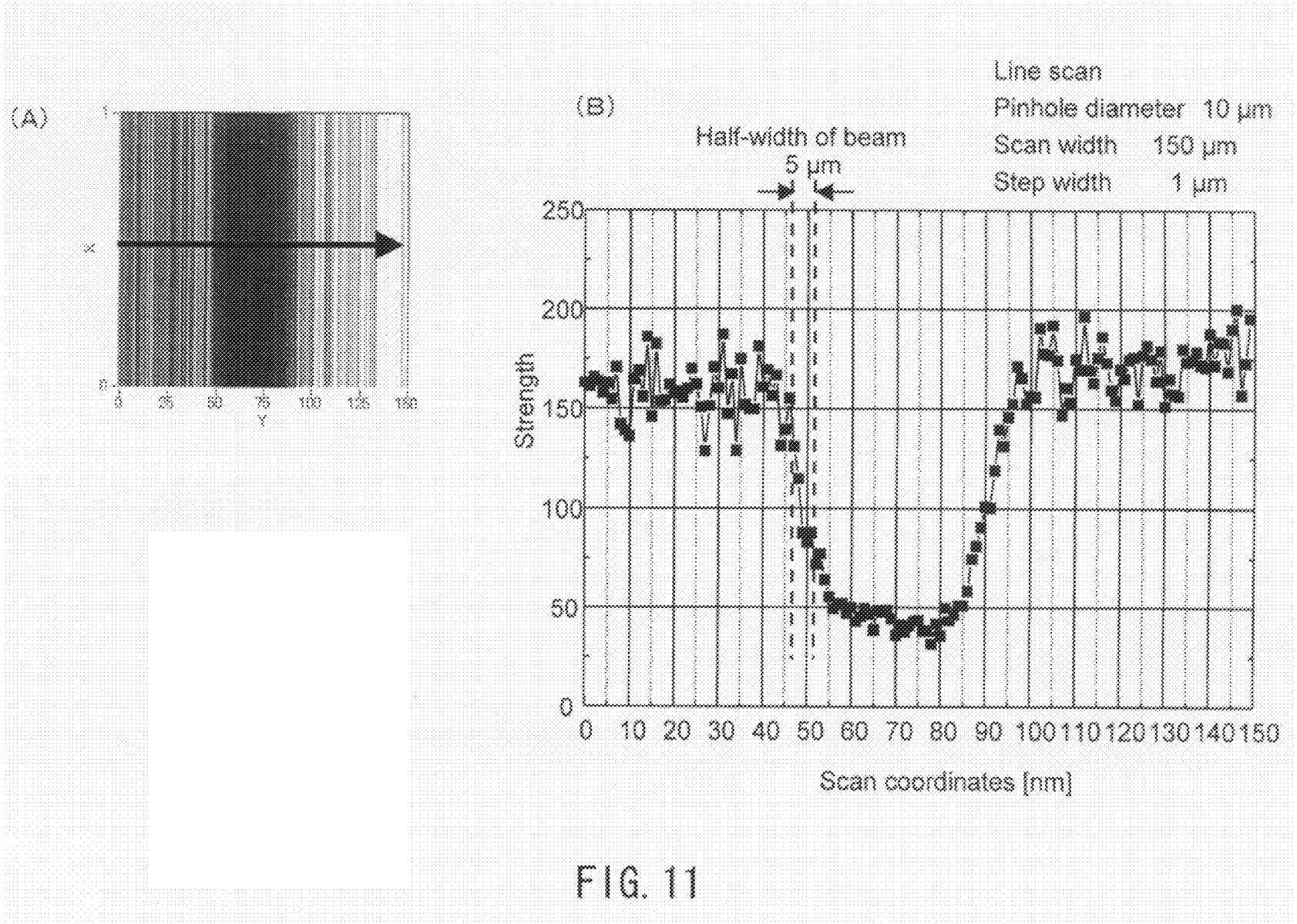
FIG. 11A shows an image picture of a triglycine thin film.
FIG. 11B is a graph showing the relationship between the ion strength and the scan coordinates of the triglycine thin film in still another example of the present invention.

(2) Moreover, as shown in an image picture in FIG. 11A, the triglycine thin film was scanned by a copper ion beam in the Y-axis direction (direction of an arrow in the figure), and the strength of secondary ions thus generated was measured. Note here that the pinhole diameter was 10 μm, the scan width was 150 μm, and the step width was 1 μm. The result is shown in a graph in FIG. 11B. It was proved from the figure that the beam had a half-width of about 5 μm.

Example 5

Figure 12:
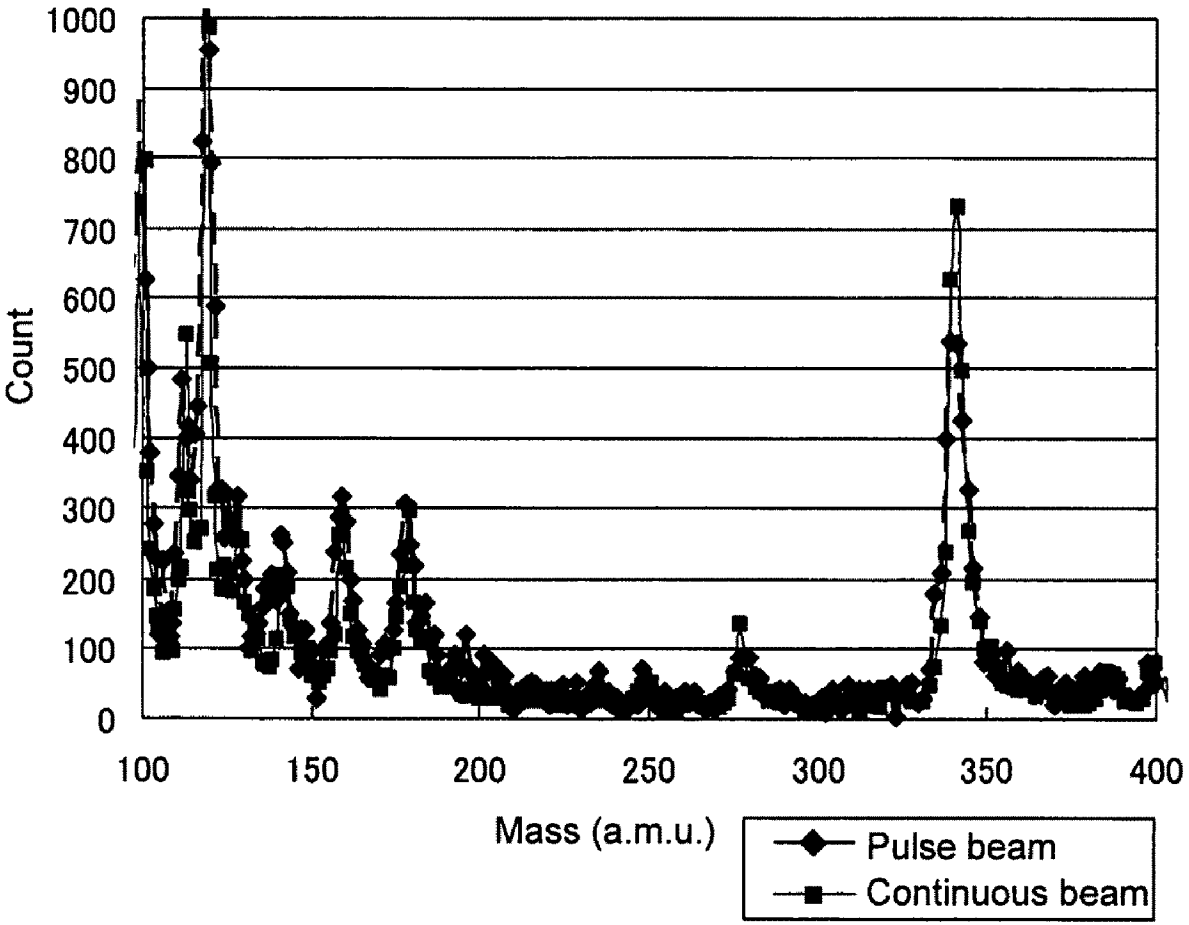
FIG. 12 shows resultant mass spectra for a trehalose thin film in still another example of the present invention.

A trehalose thin film was formed on a Si substrate in the same manner as in Example 1, and a mesh as in Example 4 was arranged on a surface of the film. Then, an $Au^{5+}$ beam of 9 MeV was irradiated continuously (100 cps) as primary ions, and TOFMS was performed with the detection of secondary electrons as an analysis start signal and the detection of negative secondary ions as an analysis end signal. On the other hand, a similar trehalose thin film was irradiated with an $Au^{5+}$ beam of 9 MeV discontinuously (pulse irradiation) under the following conditions, followed by TOFMS. The results are shown in FIG. 12.

Beam diameter: 2 mm

Beam amount: 5000 cps (continuous irradiation)

−10 pA (pulse irradiation)

Pulse: 50 nanoseconds, repetition: 10 kHz (pulse irradiation)

Measuring time: 500 seconds (pulse irradiation)

200 seconds (continuous irradiation)

Irradiation amount per measurement: $-10^{6}$ ions ($-10^{8}$ ions/$cm^2$)

Incident angle: 30°

As shown in the figure, the continuous irradiation also resulted in a spectrum similar to that resulted from the pulse irradiation, and achieved a slightly higher resolution. The result proves that TOFMS can be performed without pulse irradiation according to the method of the present invention. Further, it is also possible to reduce the beam amount, enabling the downsizing of the device, for example.

Example 6

Figure 13:
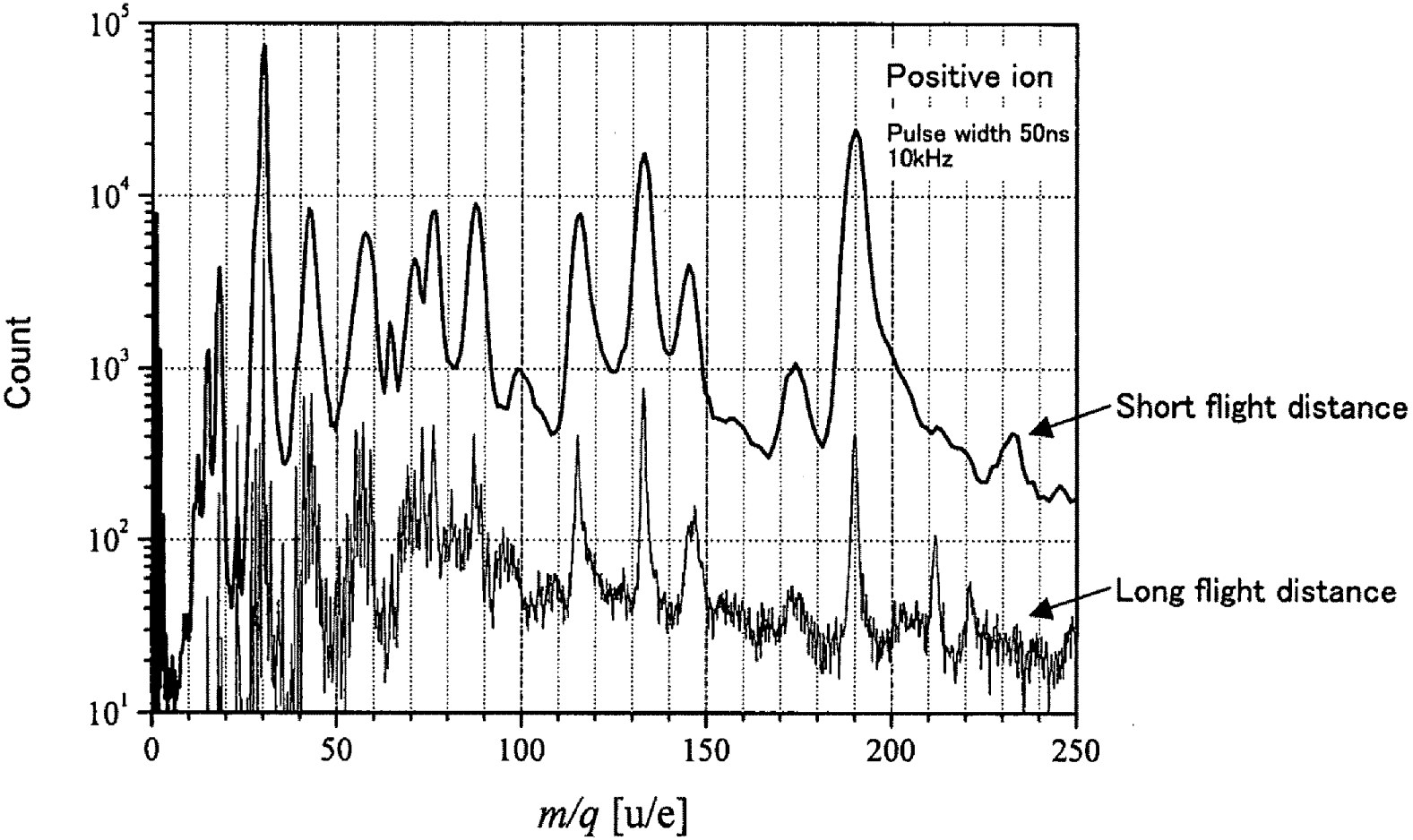
FIG. 13 shows resultant mass spectra for a triglycine thin film in still another example of the present invention.

A triglycine (Gly-Gly-Gly) thin film was irradiated with a copper ion beam (95 keV/amu) of 6 MeV, followed by mass spectrometry in the same manner as in Example 4 except that the length of a flight tube through which secondary ions fly was changed. FIG. 13 shows resultant mass spectra.

As shown in the spectra in the figure, a long flight tube resulted in a resolution of M/ΔM=120, and a short flight tube resulted in a resolution of M/ΔM=40, showing about a threefold increase in the resolution depending on the length. From this result, it can be said that the resolution can be improved further by making the flight tube longer, i.e., making a flight distance longer.

Example 7

Figure 15:
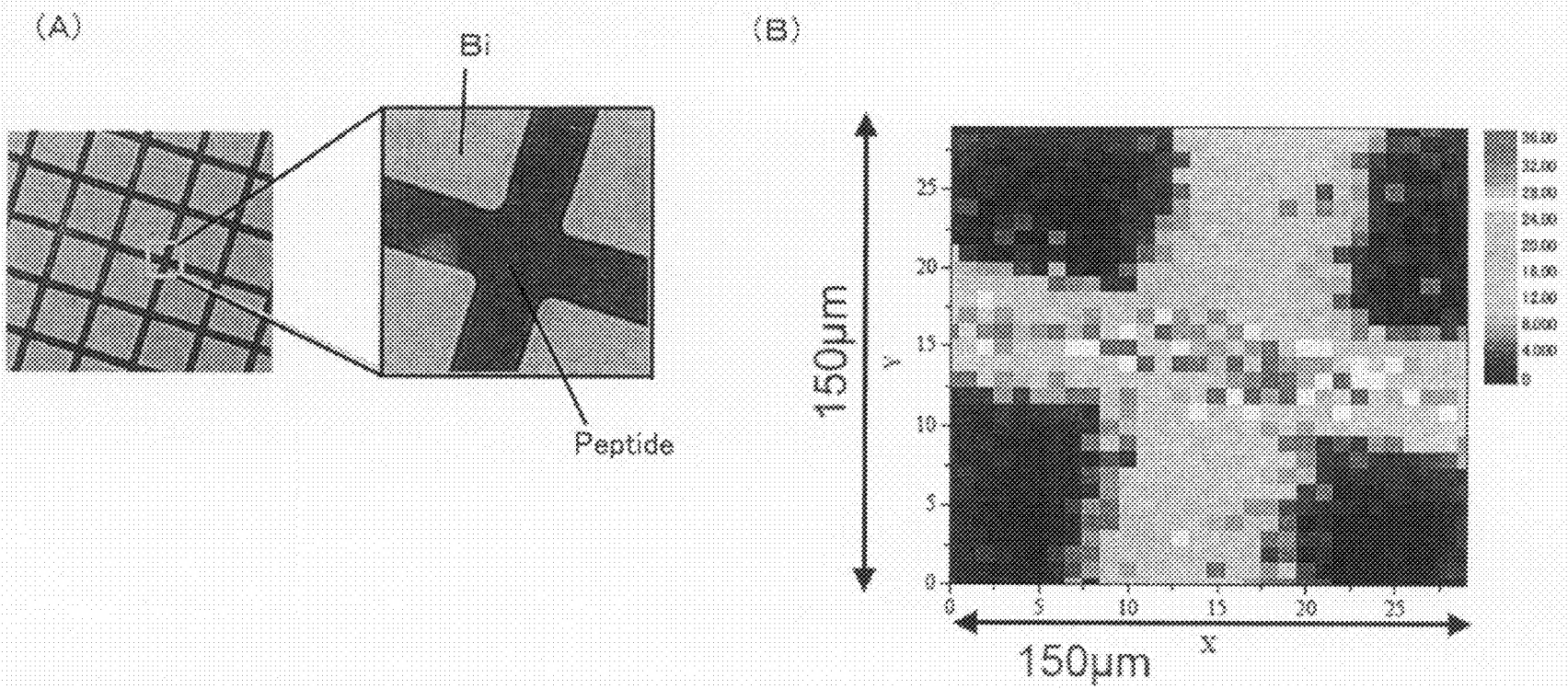
FIGS. 15A and 15B show an example of a result of imaging of peptide.

A square bismuth plate was arranged on a Si substrate, and a groove (width: 30 μm) was formed thereon in a grid pattern as shown in FIG. 15A. A solution of peptide (1154 u) as described below was dripped into the groove so as to form a thin film Then, the thin film thus obtained was irradiated with a copper ion beam (95 keV/amu) of 6 MeV, and mass spectrometry was performed, followed by imaging based on a result of the analysis. Other conditions of the mass spectrometry are the same as those in Example 1, and the peptide used is fluorescence-quenching substrate (manufactured by the PEPTIDE INSTITUTE, INC.) for caspase 3 having the following structure. MOCAc-Asp-Glu-Val-Asp-Ala-Pro-Lys (Dnp)-$NH_2$ In the above-described peptide, MOCAc represents (7-Methoxycounarin-4-yl) Acetyl, and Dnp represents Dinitrophenyl.

Figure 14:
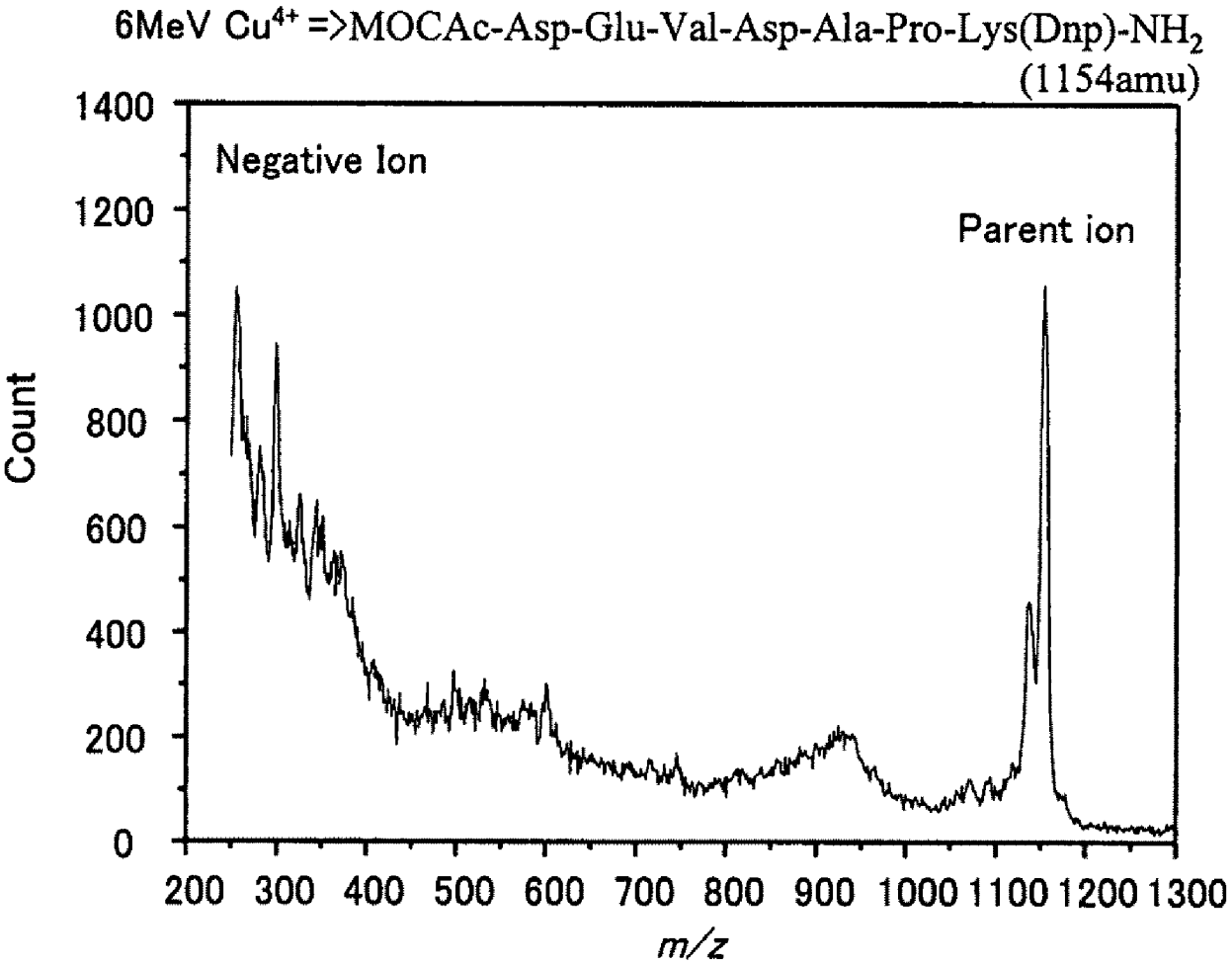
FIG. 14 shows an example of a resultant mass spectrum for peptide.

FIG. 14 shows an example of a resultant mass spectrum, and FIG. 15B shows a result of imaging. As shown in the figures, molecules with a molecular weight of more than 1000 were detected favorably. Note here that the spatial resolution of imaging was 5 μm.

Example 8

Figure 16:
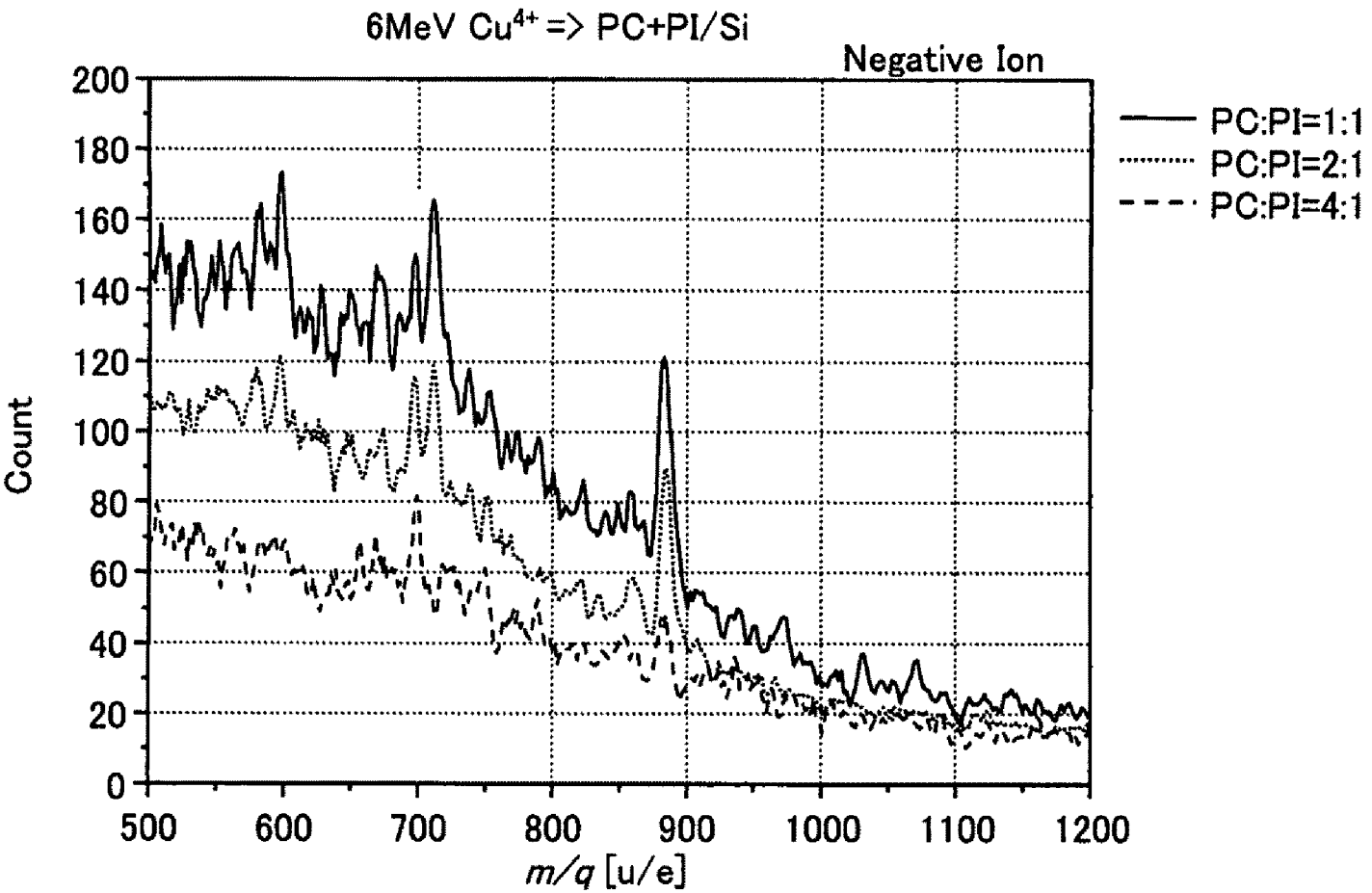
FIG. 16 shows an example of resultant mass spectra for a mixed lipid sample.

A lipid mixture of phosphatidyl choline (PC) and phosphatidyl inositol (PI) (both manufactured by Avanti Polar Lipids, Inc.) mixed at a predetermined ratio was used to form a film on a Si substrate, and the film thus obtained was irradiated with a copper ion beam (95 keV/amu) of 6 MeV, followed by mass spectrometry. Other conditions of the mass spectrometry are the same as those in Example 1. The result is shown in FIG. 16 and the following table. In conventional SIMS, when a sample to be analyzed is a mixture of lipids, they cannot be detected distinctly. According to the secondary ion mass spectrometry method of the present invention, however, a plurality of mixed lipid molecules can be subjected to a quantitative analysis as shown in the figure and the following table.

TABLE 2

| Composition ratio PC:PI | 1:1 | 2:1 | 4:1 |
|---|---|---|---|
| PI amount | 1 | 0.67 | 0.4 |
| Experimental value | 1 | 0.62 | 0.34 |

INDUSTRIAL APPLICABILITY

As described above, according to SIMS of the present invention, even when a sample to be analyzed is an organism-related material such as protein and polysaccharide, it is possible to suppress the destruction of the organism-related material caused in conventional SIMS, for example, and excellent ionization efficiency is achieved. Therefore, the present invention enables an analysis of an organism-related material such as protein with high sensitivity. Further, since a matrix as used in conventional LSIMS and MALDI is not required, a high lateral resolution can be achieved. Further, since the present invention enables mass spectrometry of an organism-related material with high sensitivity, image display can be performed in accordance with the analysis obtained. When image display is possible, the presence of an organism-related material and a distribution thereof can be confirmed easily. Consequently, the present invention is very useful as a new method for analyzing an organism-related material in various fields such as medicine and biology for clinical purpose, in drug development, and the like, for example.

The invention claimed is:

1. A secondary ion mass spectrometry method with higher sensitivity, comprising the steps of:

irradiating a sample to be analyzed including analysis target molecules with a primary ion beam; and subjecting secondary ions generated from the sample to be analyzed by the irradiation of the primary ion beam to mass spectrometry, wherein the analysis target molecules include an organism-related material with a molecular weight of 100 to 10,000, the primary ion beam is a heavy ion beam of 1.25 keV/amu or more, and the organism-related material present at the amol or sub-amol level in the sample to be analyzed can be detected.

2. The secondary ion mass spectrometry method according to claim 1, wherein the step of subjecting the secondary ions to mass spectrometry is performed using a time-of-flight ion mass spectrometer, with the detection of secondary electrons generated from the sample to be analyzed as an analysis start signal and the detection of a secondary ion beam generated subsequently as an analysis end signal.

3. The secondary ion mass spectrometry method according to claim 1, wherein the analysis target molecules are biopolymers.

4. An imaging method using secondary ion mass spectrometry, comprising the steps of:

irradiating a sample to be analyzed including analysis target molecules with a primary ion beam;

subjecting secondary ions generated from the sample to be analyzed by the irradiation of the primary ion beam to mass spectrometry; and performing image processing based on a result of the mass spectrometry of the secondary ions obtained, wherein the analysis target molecules include an organism-related material with a molecular weight of 100 to 10,000, the primary ion beam is a heavy ion beam of 1.25 keV/amu or more, and the organism-related material present at the amol or sub-amol level in the sample to be analyzed can be subjected to imaging.

5. The imaging method according to claim 4, comprising:

scanning and irradiating an XY plane of the sample to be analyzed with a primary ion beam;

subjecting secondary ions generated from each irradiated region of the sample to be analyzed to mass spectrometry; and obtaining an image signal for the each irradiated region of the sample to be analyzed based on a result of the mass spectrometry of the secondary ions, and displaying the image signal corresponding to the each irradiated region on a series of XY coordinates corresponding to the XY plane of the sample to be analyzed.

6. The imaging method according to claim 5, wherein the scanning of the primary ion beam is performed by deflecting the primary ion beam or moving the sample to be analyzed.

7. The imaging method according to claim 4, wherein a pixel has a size of 5 nm×5 nm to 20×20 μm.

8. The imaging method according to claim 4, comprising:

irradiating the sample to be analyzed with a primary ion beam, so that secondary ions are generated in a planar form;

performing mass spectrometry in a state where a relative positional relationship among the secondary ions in a plane of the sample to be analyzed is maintained; and obtaining an image signal based on a result of the analysis of the secondary ions, and projecting the image signal onto a display portion as an ionic image so that it corresponds to the positional relationship.

9. The imaging method according to claim 4, wherein an ion species of the primary ion beam is at least one selected from the group consisting of Au, Ar, Ga, In, Bi, $O_2$, Cs, Xe, $SF_5$, $C_{60}$, Ag, Si, C, and Cu.

10. The imaging method according to claim 4, wherein analysis target molecules in the secondary ion mass spectrometry are biopolymers.

11. An imaging device comprising: a secondary ion mass spectrometry means for subjecting a sample to be analyzed to secondary ion mass spectrometry; and an image processing means for performing image processing based on a result of the secondary ion mass spectrometry obtained, wherein the secondary ion mass spectrometry means includes an ion source, an irradiation means for irradiating a surface of the sample to be analyzed with a primary ion beam, and a mass spectrometry means for subjecting secondary ions generated from the sample to be analyzed by the irradiation of the primary ion beam to mass spectrometry, the ion source generates a heavy ion beam of 1.25 keV/amu or more, and the irradiation means includes a control means for controlling the primary ion beam to be generated from the ion source so that it is 1.25 keV/amu or more.

12. The imaging device according to claim 11, wherein the secondary ion mass spectrometry means includes a scanning means for scanning and irradiating an XY plane of the sample to be analyzed with a primary ion beam, and the image processing means includes an image signal generation means for obtaining an image signal for each irradiated region of the sample to be analyzed based on a result of the secondary ion mass spectrometry, and a display means for displaying the image signal corresponding to the each irradiated region on a series of XY coordinates corresponding to the XY plane of the sample to be analyzed.

13. The imaging device according to claim 12, further comprising an extended ion optical system between the sample to be analyzed and the secondary ion mass spectrometry means or between the secondary ion mass spectrometry means and the image processing means.

* * * * *